US006923365B2

(12) United States Patent
Auclair et al.

(10) Patent No.: US 6,923,365 B2
(45) Date of Patent: Aug. 2, 2005

(54) CARTON AND CARTON BLANK

(75) Inventors: Jean-Michel Auclair, Chateauroux (FR); Alain Saulas, Chateauroux (FR)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 30 days.

(21) Appl. No.: 10/411,660

(22) Filed: Apr. 11, 2003

(65) Prior Publication Data

US 2003/0226879 A1 Dec. 11, 2003

Related U.S. Application Data

(63) Continuation of application No. PCT/US01/31831, filed on Oct. 12, 2001.

(51) Int. Cl.[7] ..... B65D 5/72

(52) U.S. Cl. ..... 229/120.011; 206/804; 206/817; 221/229; 221/279; 221/280; 229/122.1

(58) Field of Search ..... 229/120.011, 122.1; 221/228, 229, 268, 269, 279, 280; 206/804, 817

(56) References Cited

U.S. PATENT DOCUMENTS

| | | | | |
|---|---|---|---|---|
| 1,409,665 A | * | 3/1922 | Butler | 206/804 |
| 2,709,519 A | | 5/1955 | Cashman | |
| 2,746,665 A | | 5/1956 | Wiggins | |
| 2,775,226 A | | 12/1956 | Early | |
| 3,168,234 A | | 2/1965 | Bartz | |
| 3,186,591 A | * | 6/1965 | Solomon | 221/305 |
| 3,528,597 A | | 9/1970 | Zastrow | |
| 3,536,247 A | | 10/1970 | Gadiel | |
| 3,589,505 A | * | 6/1971 | Burniski | 206/804 |
| 3,876,072 A | | 4/1975 | Phillips | |
| 4,377,237 A | | 3/1983 | Pawlowski | |
| 4,533,052 A | | 8/1985 | Fruchey et al. | |
| 4,752,029 A | | 6/1988 | Buford | |
| 5,014,906 A | * | 5/1991 | Gero | 206/817 |
| 5,020,719 A | * | 6/1991 | Roth et al. | 229/122.1 |
| 5,096,055 A | | 3/1992 | Opper | |
| 5,197,630 A | | 3/1993 | Kirla | |
| 5,284,292 A | * | 2/1994 | Johnson | 229/122.1 |
| 5,328,082 A | | 7/1994 | Fritz et al. | |
| 5,333,732 A | * | 8/1994 | Budny et al. | 206/804 |
| 5,390,820 A | * | 2/1995 | Wright et al. | 221/279 |
| 5,458,272 A | | 10/1995 | Ward-Weber | |
| 5,484,101 A | | 1/1996 | Hedberg | |
| 5,758,818 A | | 6/1998 | Ewing, Jr. | |
| 5,853,088 A | | 12/1998 | Saulas et al. | |

FOREIGN PATENT DOCUMENTS

| | | |
|---|---|---|
| EP | 0 928 751 A1 | 7/1999 |
| GB | 469845 | 8/1937 |
| WO | 99/48391 A1 | 9/1999 |

* cited by examiner

*Primary Examiner*—Gary E. Elkins
(74) *Attorney, Agent, or Firm*—Tsugihiko Suzuki

(57) ABSTRACT

A carton and blank for forming a carton for accommodating one or more articles which carton is provided with an access structure for the removal of articles from within the carton. The access structure comprises a closure panel hinged to a carton wall for forward and backward pivotal movement and a movable platform hinged to the closure panel for moving the contents of the carton forward for their removal in response to the forward pivotal movement of the closure panel.

14 Claims, 18 Drawing Sheets

CARTON AND CARTON BLANK

This is a continuation of international application No. PCT/US01/31831, filed Oct. 12, 2001, which is hereby incorporated by reference.

BACKGROUND OF THE INVENTION

The invention relates to a carton for accommodating one or more articles, for example washing powder tablets, which carton is provided with an access structure for the introduction to or removal of the articles from the carton. The invention also provides an article feeder to assist in the removal of articles. Multiple packaging is also disclosed in which there is shown a divisible cartons and a blank for forming the same. The divisible carton is provided with an outer cover and means to separate one part of the carton from another.

It is known from, for example, U.S. Pat. No. 5,458,272 to produce a carton having a swingable closure panel and a pair of wing flaps, each wing flaps having stopper elements limiting outward movement of the closure panel. In U.S. Pat. No. 4,752,029 there is shown a carton including a swingable closure panel hinged at its lower edge to a front wall for forward and backward pivotal movement and a dispensing device for gravity feeding the contents of the carton.

A problem associated with the prior art is how to provide a positive feed to improve the removal of articles without damaging the integrity of the carton. The present invention and its preferred embodiments seek to overcome or at least mitigate the problems of the prior art.

As regards the divisible carton, it is known from U.S. Pat. No. 4,533,052 (Fruchey) to provide a divisible carton including two open top modular boxes horizontally arranged in a row and connected together by means of a common top cover. Another example is illustrated in U.S. Pat. No. 4,377,237 (Pawlowski) which shows an access structure including a closure panel which is maintained in a closed position by a glue flap.

In the prior art, some form of glue flap or mechanical lock is required to secure the access structure, and in particular, maintain the closure panel in a closed arrangement prior to being opened. Such arrangements are therefore complex and require additional manufacturing processes in order to construct the carton, which is undesirable.

In an alternative form, it is known from U.S. Pat. No. 5,853,088 to provide two or more open top modular boxes arranged vertically one above the other and connected together by means of an outer cover. A problem associated with such an arrangement is that once each box has been separated, the boxes cannot be reconnected.

SUMMARY OF THE INVENTION

The present invention in its preferred embodiment seeks to overcome or at least mitigate the problems of the prior art.

A first aspect of the invention provides a carton for accommodating one or more articles which carton is provided with an access structure for the removal of articles from within the carton. The access structure comprises a closure panel hinged to a carton wall for forward and backward pivotal movement and a moveable platform hinged to the closure panel for moving the contents of the carton forward for their removal in response to the forward pivotal movement of the closure panel.

According to an optional feature of the first aspect of the invention the platform may comprise a platform panel adapted to move forwardly and downwardly to present the articles thereon for removal as the closure panel is swung open to a dispensing position.

Preferably, the movable platform is hinged to the closure panel along a fold line spaced above lower edge of the closure panel. More preferably, the platform is spaced from the base of the carton by a spacer panel.

A second aspect of this invention provides a carton for accommodating one or more articles, which carton comprising a closure panel hinged at its lower edge to a carton wall for forward and backward pivotal movement. There further comprises a pusher element linked to the closure panel to push an article held within the carton forward in response to forward movement of the closure panel.

Optionally the pusher element is hinged at its lower edge to the carton wall. The pusher element may be linked to the closure panel by a connecting panel spaced from the carton wall. Articles held within the carton may be placed upon the connecting panel.

A third aspect of the invention provides a carton for accommodating a plurality of articles, which carton having a dispensing drawer comprising a closure panel hinged to a carton wall for movement between open dispensing position and a closed position and at least one wing flap hinged to the closure panel and extending into the carton for movement along with the closure. The one wing flap has an anchoring element for engaging with a carton wall to retain the closure panel in a closed position.

The at least one wing flap may further comprises a stopper element spaced from the anchoring element which stopper element limits the outward movement of the closure panel. Optionally, the anchoring element and/or the stopper element comprises a protrusion positioned on an upper edge of at least one wing flap.

A fourth aspect of the invention provides a blank for forming a carton for accommodating one or more articles the blank comprising a plurality of wall panels, for forming a base, a top and opposed side and end walls, and an access structure comprising a closure panel hinged to a first wall panel for forward and backward pivotal movement in a set up condition and panels for forming a moveable platform comprising a spacer panel, a platform panel and a securing flap for securing the platform to the closure panel.

A fifth aspect of the invention provides a blank for forming a carton for accommodating one or more articles, which blank comprising a plurality of wall panels hingedly connected together for forming a top, a base and opposed side and end walls and a closure panel hinged at its lower edge to a first wall panel for forward and backward pivotal movement in a set up condition. A pusher element is provided hinged at its lower edge to the first wall panel and a linkage panel is hingedly connected to an intermediate portion of the pusher element and a securing flap connected to the linkage panel for securing to the closure panel.

A sixth aspect of the invention provides a blank for forming a carton for accommodating a plurality of articles, for example washing power tablets, which blank having a dispensing drawer comprising a swingable closure panel hinged to a first wall panel and at least one wing flap hinged to the closure panel. The at least one wing flap has an anchoring element for engaging with an adjacent wall panel to retain the closure panel in a closed position when the carton is in a set up condition.

Preferably the at least one wing flap further comprises a stopper element spaced from the anchoring element which stopper element limits the outward movement of the closure panel when the carton is in a set up condition. More preferably, the anchoring element and/or the stopper element comprises a protrusion positioned on an upper edge of at least one wing flap.

A seventh aspect of the invention provides a divisible carton comprising two or more modular boxes for packaging articles, such as tablets for example, each modular box having a structure to access the box interior and a common outer upper cover arranged so as to secure the boxes together and wherein a tear strip is provided so as to permit the boxes to be separated. Preferably, the boxes are secured together such that the access structures are placed in a mutually opposed relationship to prevent access until one box is separated from the other part of the carton. More preferably, the access structure comprises a swingable closure panel.

An eighth aspect of the invention provides a divisible carton comprising two or more open top modular boxes arranged vertically and interconnected by means of a cover secured to the side edges of each box, each box having end panels of greater vertical height in relation to the side panels, and wherein tear strips are located on the cover adjacent to each box interface such that the upper edge thereof is located at an elevation equal to or higher than the elevation of the adjacent box bottom to enable each box, when separated, to be reclosed by the upper adjoining box.

According to an optional feature of the eighth aspect of the invention the lower edge of each strip is at a lower elevation than the adjacent box bottom.

According to another optional feature of the eighth aspect of the present invention the upper portion of the cover may further extend over the top of the uppermost box. Optionally, a further tear strip extends across the upper cover portion to enable access to the interior of the uppermost box. Preferably, the upper parts of the modular boxes are adapted to allow the adjacent modular box to nest therein.

A ninth aspect of the invention comprises a three part blank for forming a divisible carton comprising first and second blanks having a base, side and end panels for forming open topped boxes and a third blank for forming a top cover structure to be secured to the boxes and having a tear strip so as to enable box separation, wherein each box is provided with an access structure.

A tenth aspect of the invention provides a three part blank for forming a divisible carton comprising first and second blanks having base side and end panels for forming open topped boxes and a third blank for forming a cover structure having tear strips provided therein at box interface positions when secured to the sides of the open topped boxes wherein the end panels of the box blanks have a greater vertical height than the side panels of the box blanks.

BRIEF DESCRIPTION OF THE DRAWINGS

Exemplary embodiments will now be described, by way of example only, with reference to the accompanying drawings in which.

DETAILED DESCRIPTION OF THE PREFERRED EMBODIMENTS

Figure 1:
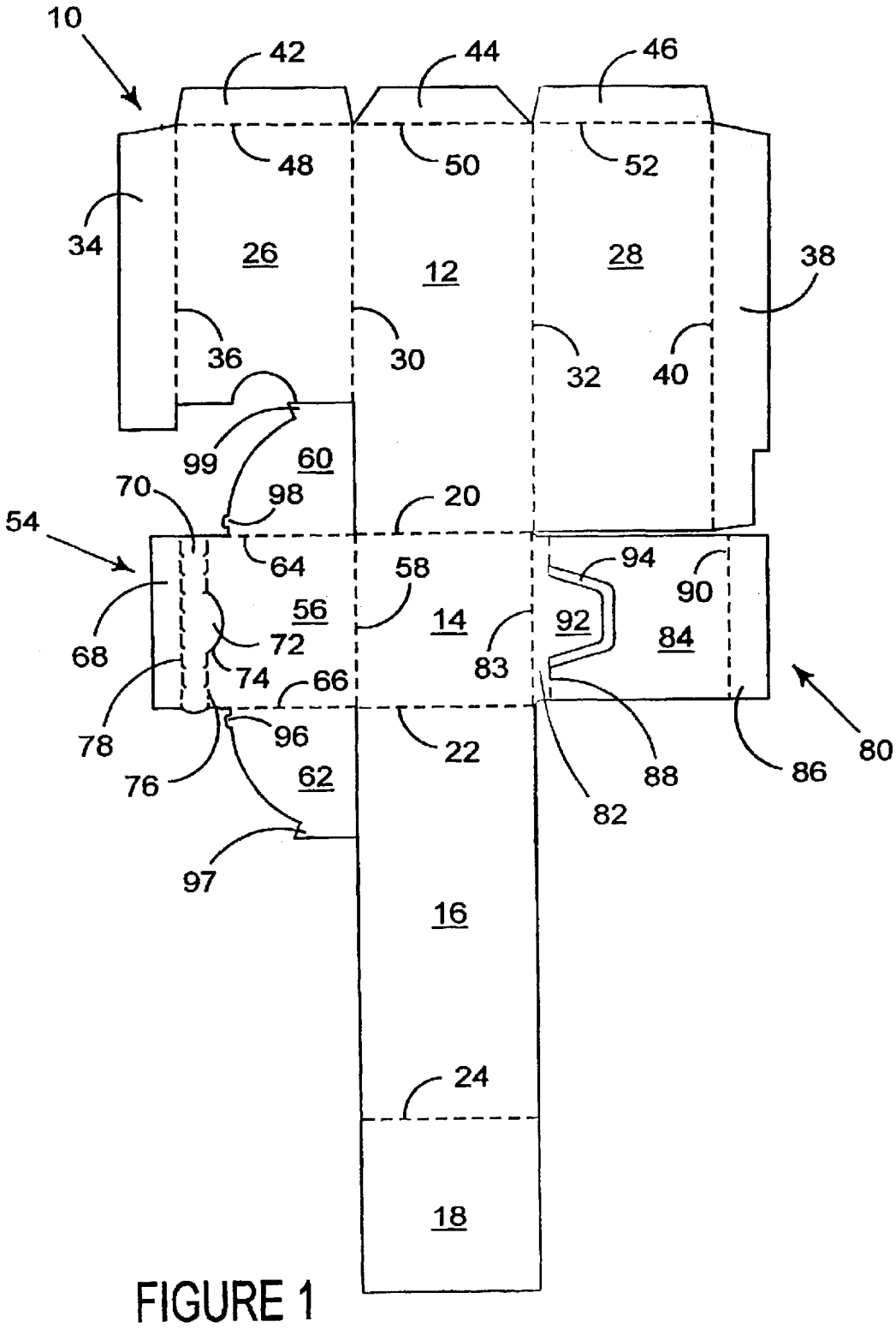
FIG. 1 is a plan view of a blank for forming a carton according to a first embodiment of the invention.

Referring to the drawings there is shown several embodiments of carton and blanks for forming a carton. The blanks and carton are formed from paperboard or other suitable foldable sheet material, that has been cut and fold lines added. The carton is used to hold a plurality of articles, for example, washing powder tablets or the like, and to dispense the article. The invention also covers a divisible carton for multiple packaging. Whilst in the illustrated embodiments, a unitary blank is used to make a single carton, it is envisaged that two or more blanks may be employed, for example to provide the access structure 54 or feed means 80, described in more detail below.

Referring now to FIG. 1, there is shown a blank for forming a carton with an access structure. The blank 10 comprises in series, a first side wall panel 12, base panel 14, a second side wall panel 16, and a top panel 18, hingedly connected together along fold lines 20, 22 and 24 respectively.

There further comprises opposed end wall panels 26 and 28. In this embodiment, end wall panel 26 is hingedly connected to a longitudinal edge of side wall panel 12 along the fold line 30 and opposed second end wall panel 28 is hingedly connected to a side wall panel 12 along fold line 32. In order to secure the panels of the carton together there further comprises a series of securing flaps. It will be seen that end wall panel 26 is secured to side wall panel 16 by securing flap 34 which is hingedly connected to end wall panel 26 along fold line 36. Similarly, a securing flap 38 is hingedly connected to side wall panel 28 along fold line 40.

In order to construct the top wall structure, there comprises securing flaps 42, 44 and 46 hingedly connected to end wall panel 26, side wall panel 12 and second end wall panel 28 respectively along fold lines 48, 50 and 52.

There comprises an access structure 54 to gain access to the interior of the carton to retrieve articles contained therein. In one class of embodiments, there comprises a dispensing drawer provided by a swingable closure panel 56 hingedly connected to one of the outer panels of the carton, for example base wall panel 14 along fold line 58. There may further comprise one or more wing flaps 60 and 62, which in this embodiment are provided on each side of the closure panel 56. Wing flaps 60 and 62 are hingedly connected thereto along fold lines 64 and 66 respectively. Each wing flap is optionally provided with a stopper element 97, 99 to limit the outward movement of the respective closure panel 56. There may further comprise one or more anchor elements 96, 98 to retain the closure panel in a closed position. Preferably, the stopper and anchor elements protrude from the upper edge of the respective wing flaps.

The set up carton C (FIG. 3) is supplied to the end user with the closure panel 56 secured in a closed position. To achieve this, there further comprises a securing panel 68 and frangible connecting portion 70 hingedly connected to the closure panel 56 along frangible lines 76 and 78 respectively. In this embodiment, a tab 72 is provided together with cut line 74 so as to provide a recess in the set up carton to make it easier for a user to grip the dispensing drawer.

In some embodiments, there further comprises an article feeder 80. The article feeder is provided with a platform upon which the articles A (FIG. 5) are placed. The platform is connected to the closure panel 56 and is moveable within the carton. In FIG. 1, the platform is provided by a spacer panel 82, a platform panel 84 and securing means for securing the platform panel 84 to the closure panel 56. The spacer panel 82 is connected to base panel 14 along fold line 83 and platform panel 84 is hingedly connected to spacer panel 82 along fold line 88. The securing means is, in this embodiment, provided by a securing flap 86 which is hingedly connected to the opposing end edge of platform panel 84 along fold line 90.

There may further comprise a pusher element 92 which is linked to the closure panel 56 to push the contents of the carton forward in response to forward movement of the closure panel 56. The pusher element 92 may be provided by a separate arrangement or, as in this embodiment, linked to the platform. Thus, there is provided a pusher tab 92 which is an extension of spacer panel 82. Pusher element 92 is separated from platform panel 84 by aperture 94 or a cut line. Thus, the pusher element 92 pivots about fold line 83.

Turning to the construction of the carton illustrated in FIGS. 2 to 6, it is envisaged that the carton of the present invention can be formed by a series of sequential folding and gluing operations to be performed in a straight line machine, so that the carton is not required to be rotated or inverted to complete its construction. The folding and construction process is not limited to that described below and can be altered according to particular manufacturing requirements.

Figure 2A:
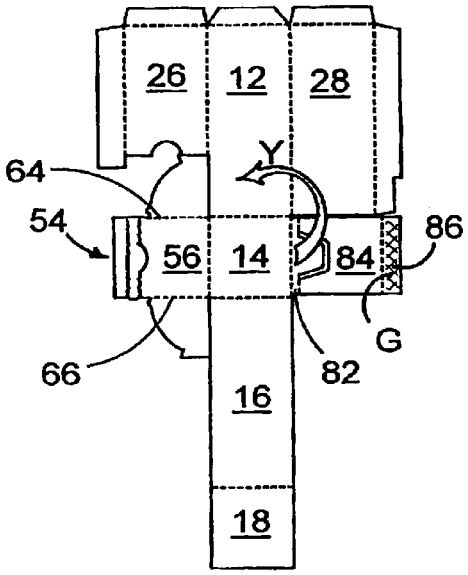
FIGS. 2A, 2B, 2C and 2D illustrate the construction of the carton from the blank shown in FIG. 1.
Figure 2B:
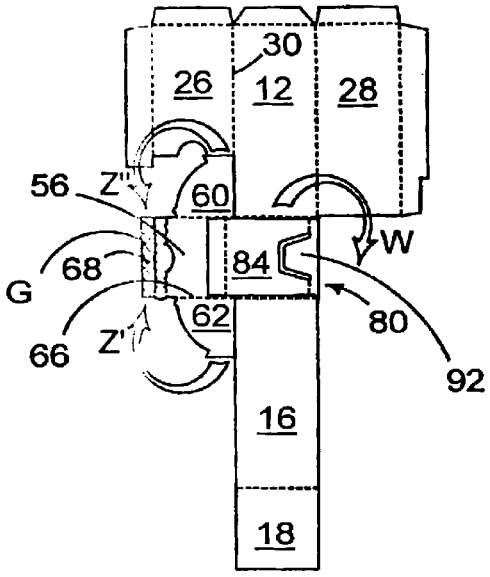

Referring to FIGS. 2A to 2D, the platform is constructed first, whereby spacer panel 82, platform panel 84 and securing flap 86 are folded in direction Y about fold line 83 and into face contacting arrangement with base panel 14 and access closure panel 56. Securing flap 86 is secured to closure panel 56 by suitable securing means, for example glue G or other means known in the art. In FIG. 2B, side panel 12 and the associated end wall panels 26 and 28 are folded in an upward direction Z along fold line 20 and end wall panel 26 is folded out of alignment with side wall panel 12 along fold line 30, so as to receive the securing flap 68 of the access structure 54.

Figure 2C:
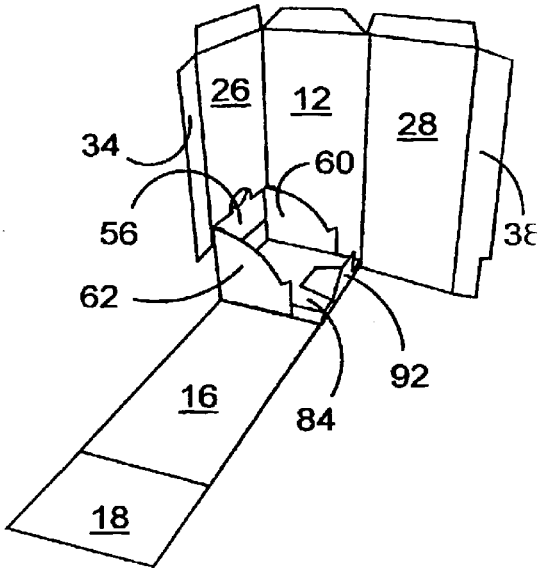
Figure 2D:
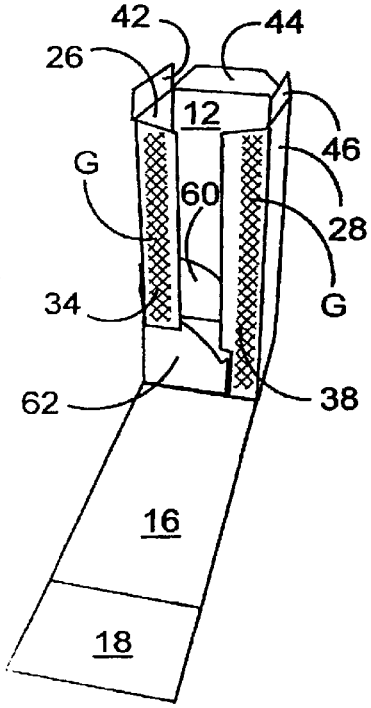

The access structure 54 is formed by inwardly folding wing flaps 60 and 62 along fold lines 64 and 66 respectively in directions Z' and Z". Closure panel 56 is then folded in direction W about fold line 58 and securing flap 68 is secured to a lower portion of end wall panel 26 as is shown in FIG. 2C. It will be seen that the folding action of closure panel 56 causes pusher element 92 to be erected and for the platform panel 84 to be folded out of alignment with spacer panel 82. Thus the article feeder 80 and access structure 54 are placed in the set up condition.

The remaining panels of the outer carton are formed whereby the opposing end panel 28 is folded into an substantially perpendicular relationship with side wall panel 12 along fold line 32. Securing flaps 34 and 38 are folded along fold lines 36 and 40 into a position and side wall panel 16 is folded along fold line 22 into face contacting arrangement. Side wall panel 16 is secured to securing flaps 34 and 38 by glue G or other suitable means known in the art.

Figure 3:
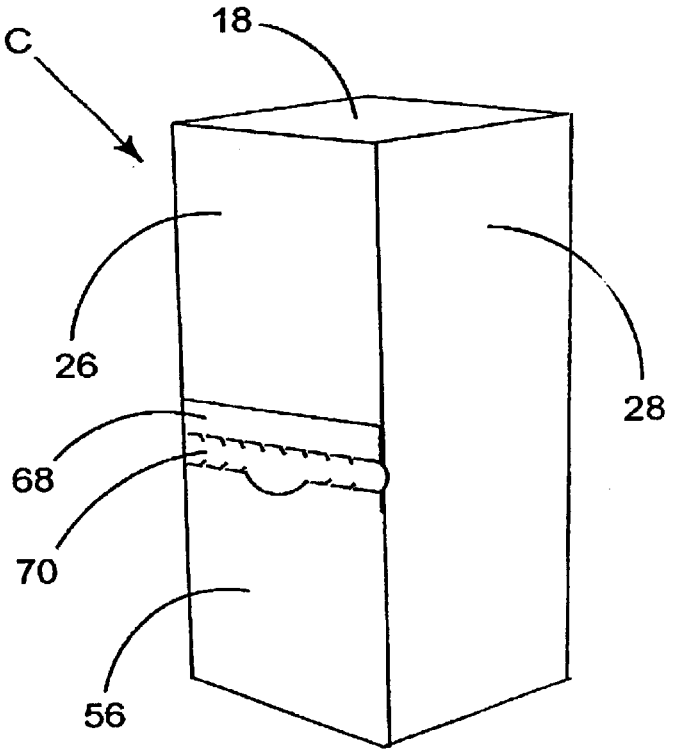
FIG. 3 is a perspective view showing the carton in a set up and loaded condition.
Figure 4:
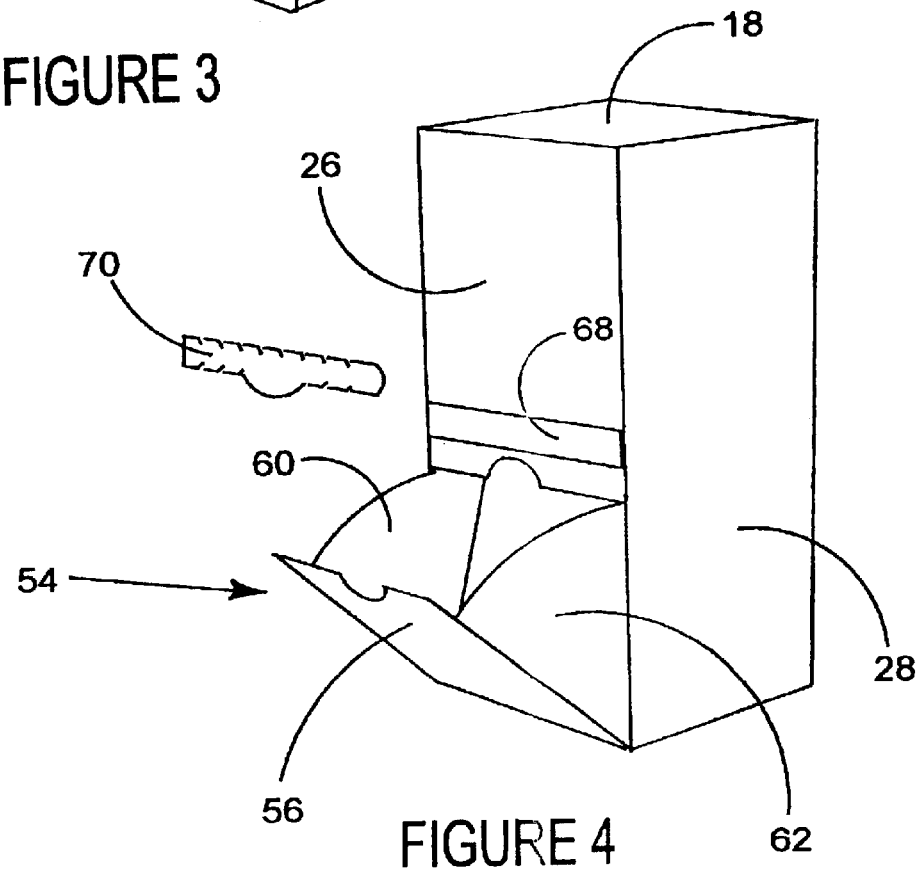
FIG. 4 is a perspective view of the carton blank of FIG. 1, illustrating the access structure in an open position.

Finally the articles are loaded into the carton C by a relative vertical movement between the carton and the articles during continuous forward feed, as is well known, and the top wall is formed by top panel 18 secured to securing flaps 42, 44 and 46 to complete the construction of the carton C as illustrated in FIG. 3. It is envisaged that the carton could be placed on its side or end and articles inserted from the side or the end prior to completing construction, as is well known in the beverage packaging industry.

The carton in FIG. 3 is supplied to an end user. In order to gain access to the interior of the carton, the access structure 54 is used. More particular, the access structure 54 provides temporary access to the interior of the carton by creating an opening in one of the end walls. In order to move the closure panel 56 from closed position to an open position, the frangible panel 70 is removed from the carton by tearing along frangible lines 76 and 78 to reveal an aperture. The user can then pull on the closure panel 56 to cause it to pivot about fold line 58 shown in FIG. 4. Closure panel 56 is pivoted to a predetermined position defined by the anchoring elements 97 and 99 as mentioned above, the anchor elements come into abutment with end wall panel 26 as is shown in FIG. 6, to prevent further movement of closure panel 56.

To reclose the access structure 54, the closure panel 56 is pushed inwardly and engaging elements 98 are pushed beyond end wall panel 26 in the carton to provide an interference type fit, thereby to prevent closure panel 56 from inadvertently opening.

Figure 5:
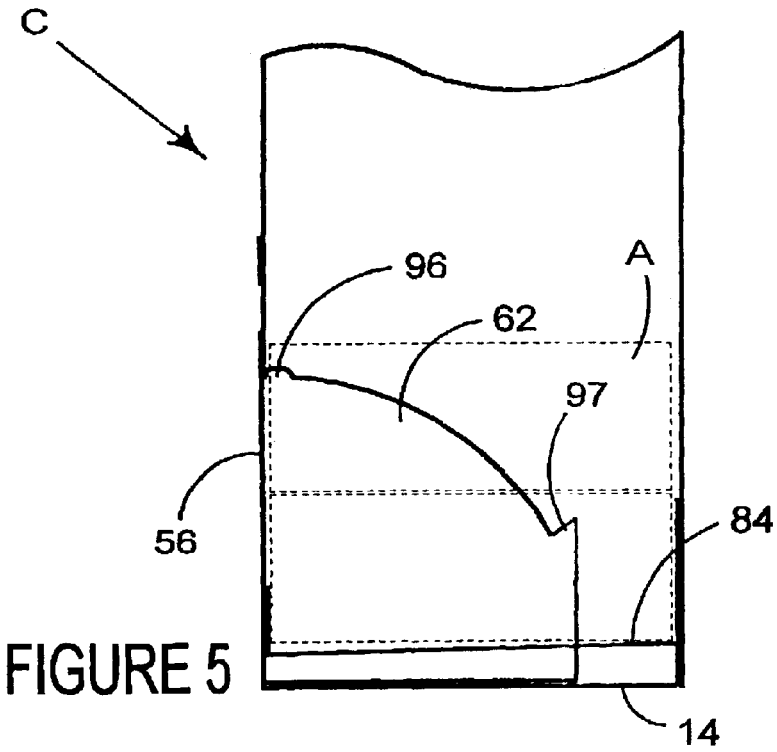
FIG. 5 is a cross-section of the carton shown in FIG. 3, with the access structure in a closed position.
Figure 6:
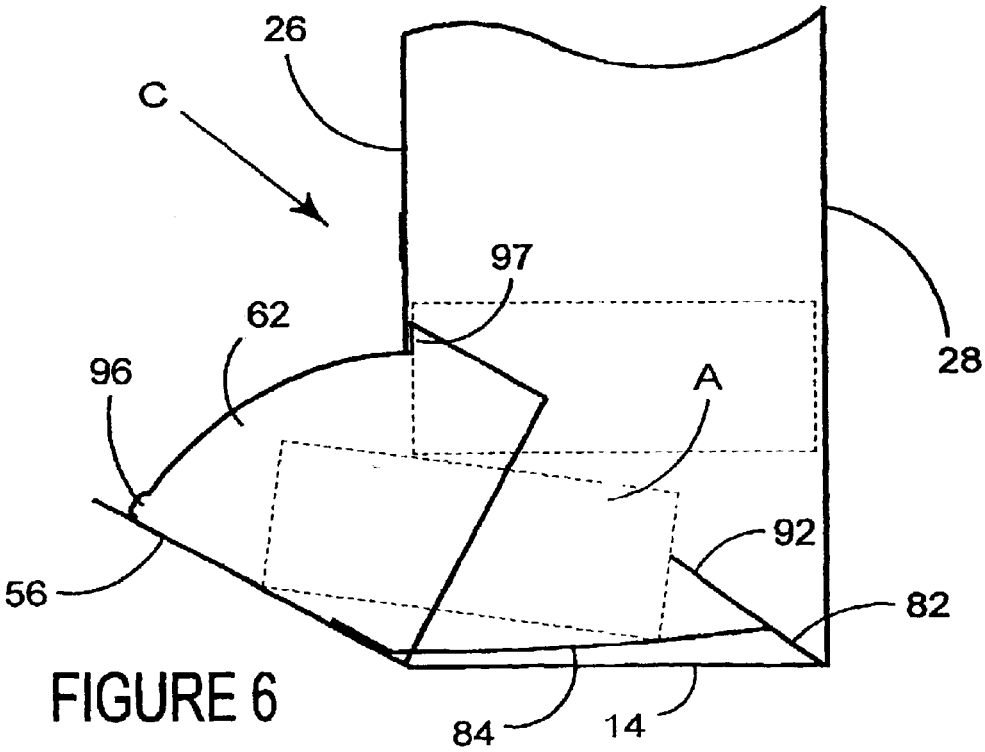
FIG. 6 is a cross-section of the carton with the access structure in an open position, shown in FIG. 4.

It will be seen from FIGS. 5 and 6 that the article feeder operates when the closure panel 56 is moved between closed and open positions. Thus, the platform panel 84 is moveable in a forward and backward direction so that an article A on platform panel 84 will be moved forward with respect to other articles contained in the carton thereby allowing easier access to remove it from the carton. In order to assist the forward movement, the pusher element 92 abuts a rear portion of the article and is pivoted about fold line 83 during the forward movement of the closure panel to push the contents of the carton forward, as is shown in FIG. 6. In one class of embodiments, the platform panel is oriented in a downward plane toward the closure panel 56 when the closure panel 56 is in an open position. This is achieved by securing the flap 86 towards the bottom of closure panel 56. Of course, in other embodiments, the platform panel 86 can be oriented to remain in a substantially horizontal plane to maintain the articles in the same plane during their removal.

Figure 7:
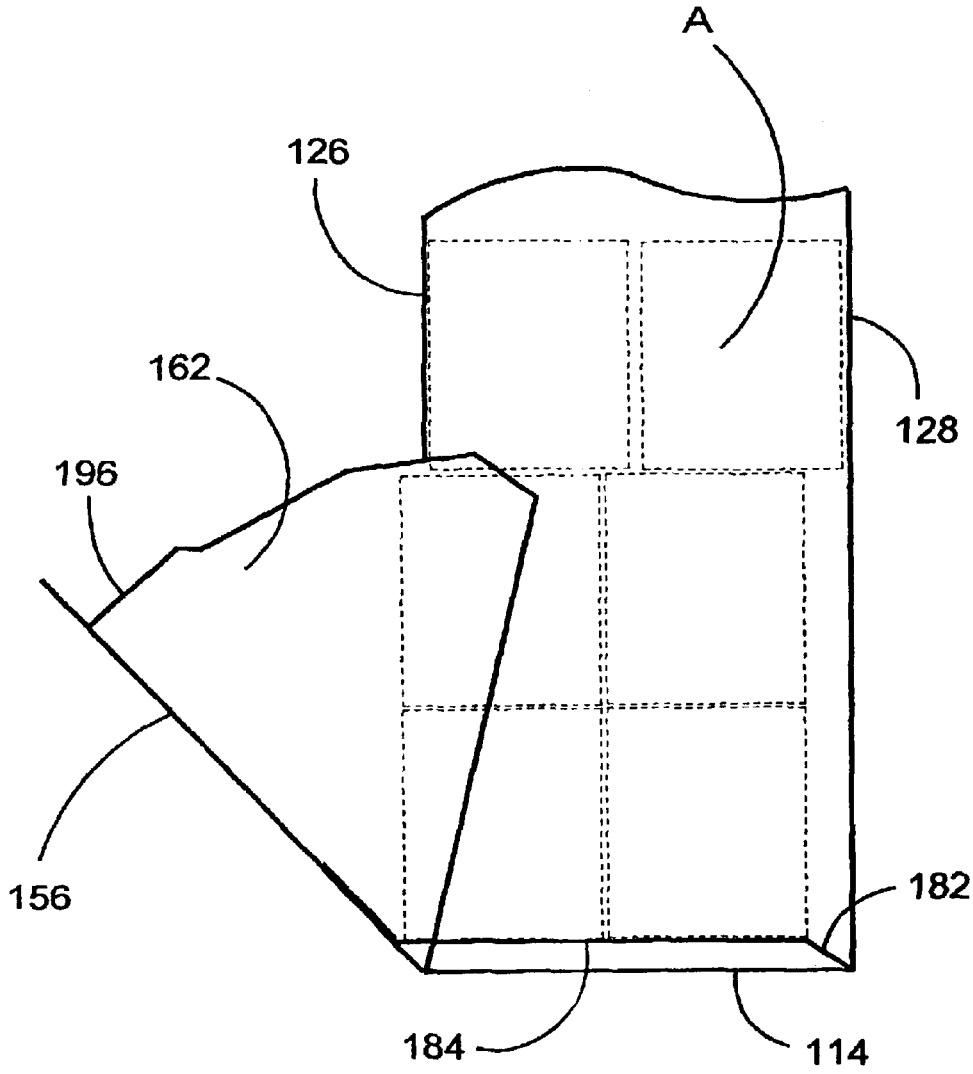
FIG. 7 is a cross-section of another embodiment of dispensing device.

A second embodiment is illustrated in FIG. 7 and is similar to the first embodiment so like references have been used with the prefix "1". It will be seen that the dispensing drawer is provided with a closure panel 156 hingedly connected to base 114. Wing flaps 162 are provided with anchoring elements 196. In this embodiment, anchoring element 196 is adapted to provide an interference type fit with the lower edge of end wall panel 126.

A platform is provided for moving articles A contained in the carton forward during forward movement of the closure panel 156. The platform comprises a platform panel 184 hingedly connected to closure panel 156 and a spacer panel 182 interconnecting platform panel 184 and base 114.

In use the platform operates in like manner to the first embodiment, so shall not be described in any greater detail.

Turning to the divisible carton, reference is made to the drawings and in particular FIGS. 8 to 31. There is shown various embodiments of modular carton and blanks for forming an open top modular box. The blanks are formed from paperboard or other suitable foldable sheet material. Turning to the first embodiment of FIGS. 8 and 9, there is shown a blank for forming a top cover formed from like material. Whilst in this embodiment, a two part blank is employed. It is envisaged that the modular boxes could be constructed from a unitary blank without departing from the scope of invention.

Figure 8:
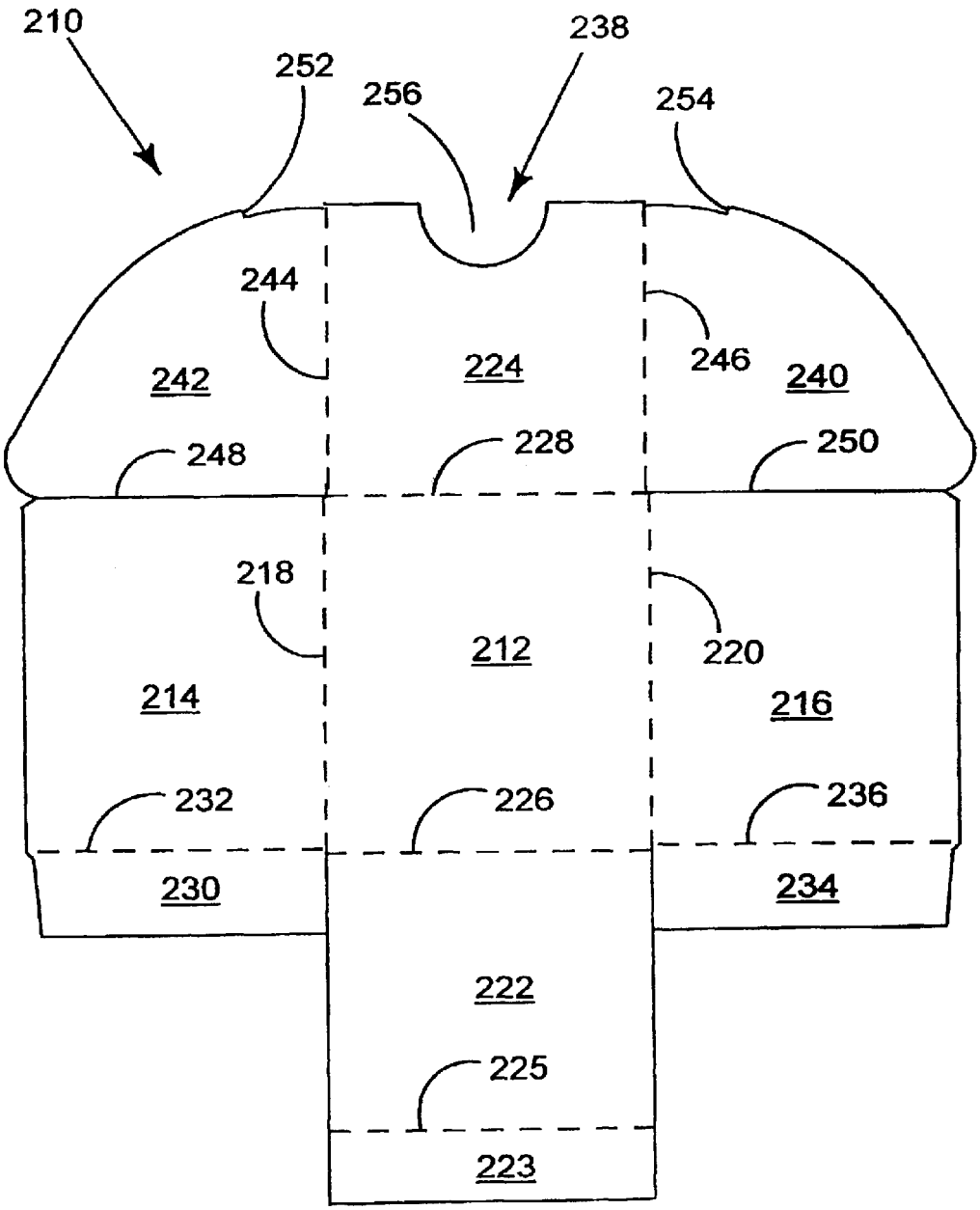
FIG. 8 is a plan view of a blank for forming a modular box with an access structure according to a further embodiment of the invention.
Figure 9:
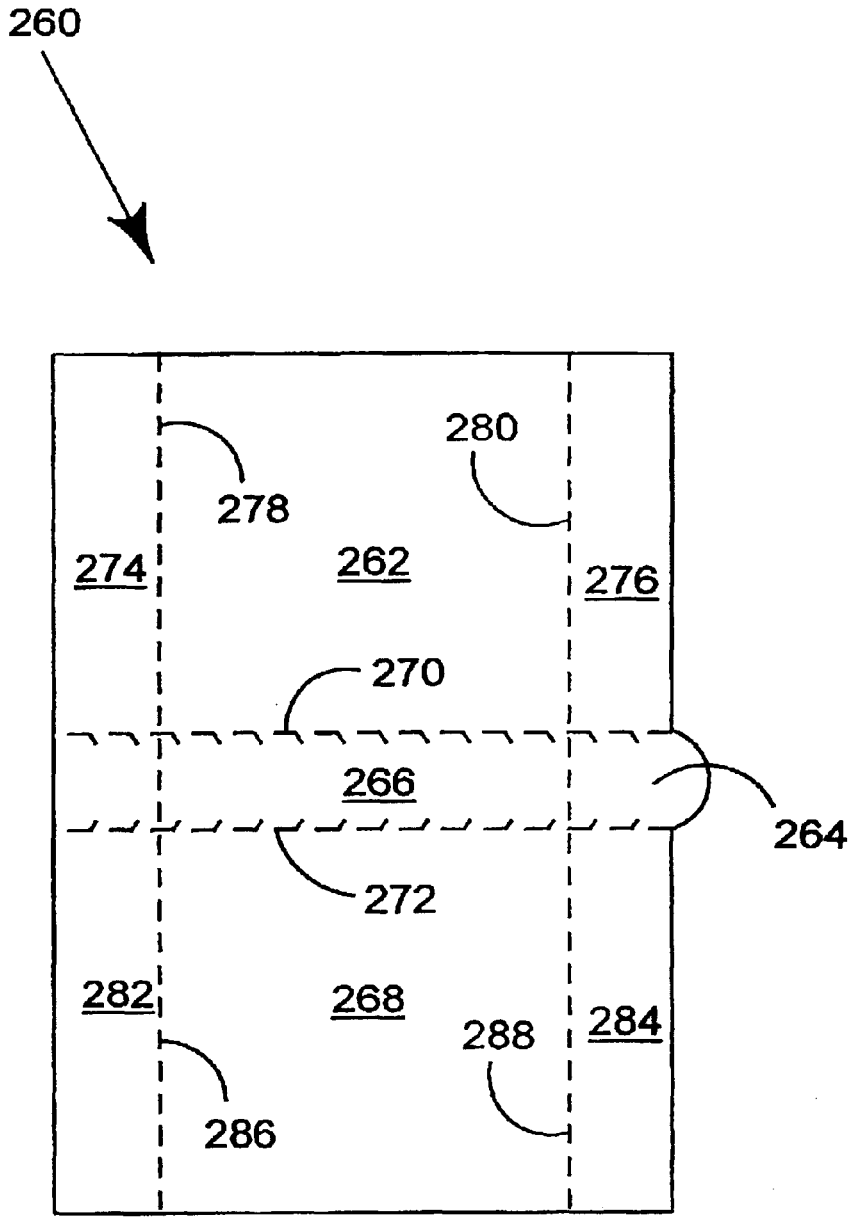
FIG. 9 is a plan view of a blank for forming an outer cover to be used with the blank of FIG. 8.

Referring to FIG. 8, the blank 210 comprises in series a first side wall panel 214, a base 212 and a second side wall panel 216 hingedly connected together along fold lines 218 and 220 respectively. There further comprises an end wall panel 222 hingedly connected to a first lateral edge of base panel 212 along fold line 226. Along the opposite lateral edge, there is provided a closure panel 224 which is hingedly connected thereto along fold line 228. The closure panel 224 forms part of the access structure 238, described in more detail below.

In order to secure the side and end wall panels together, there is provided a plurality of securing flaps 230, 234 in this embodiment hingedly connected to side wall panels 214 and 216 respectively along fold lines 232 and 236. A securing flap 223 for securing end wall panel 222 to the outer cover OC (FIG. G may be hingedly connected to end wall panel 222 along fold line 225).

The access structure 238 is provided to gain access to the interior of the carton to retrieve articles contained therein. In this embodiment, there comprises a dispensing drawer which is provided by the swingable closure panel 224 hingedly connected to one of the outer panels of the carton, for example base wall panel 212 along fold line 228. There further comprises one or more wing flaps 240, 242 which in this embodiment are provided on each side of the closure panel 224. Wing flaps 240, 242 are hingedly connected to closure panel 224 along fold lines 246, 244. Each wing flap is optionally provided with a stopper element (not shown) to limit the outward movement of the respective closure panel 224. There may further comprise one or more anchor elements 252, 254 to retain the closure panel 224 in a closed position. Preferably, the stopper and or anchor elements protrude from the upper edge of the respective wing flaps 240 and 242. It will be seen from FIG. 8 that, in this embodiment, wing flaps 240 and 242 are separated from adjacent panels forming the side wall by cut lines 248 and 250 respectively.

Turning to the blank 260 for forming the outer cover, there comprises a first top panel 262 and a second top panel 268 which are connected together by a frangible connecting portion 266. Portion 266 is secured to the first top panel 262 along frangible line 270 and to the second top cover 268 by frangible line 272. Along each longitudinal edge of the first and second top panels 262 and 268 there is provided securing flaps 274, 276 and 282, 284 respectively for securing the outer cover to the modular boxes. Securing flaps 274, 276 are hingedly connected to first cover panel 262 along fold lines 278 and 280 and securing flaps 282 and 284 are hingedly connected to second top panel 268 along fold lines 286 and 288 respectively.

The frangible connecting portion 266 may be provided with a pull tab 264 to assist in removing the frangible portion from the divisible carton.

Figure 10A:
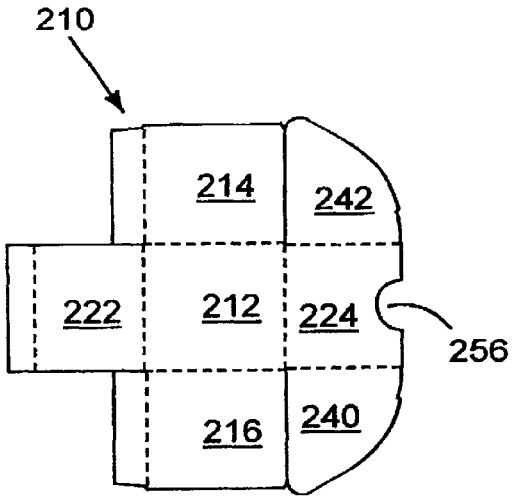
FIGS. 10A and 10B illustrate two modular boxes of FIG. 8.
Figure 10B:
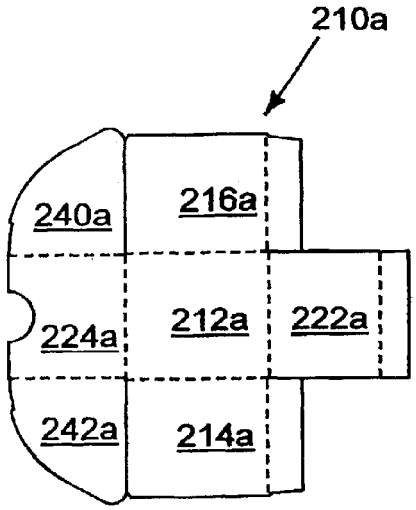
Figure 12:
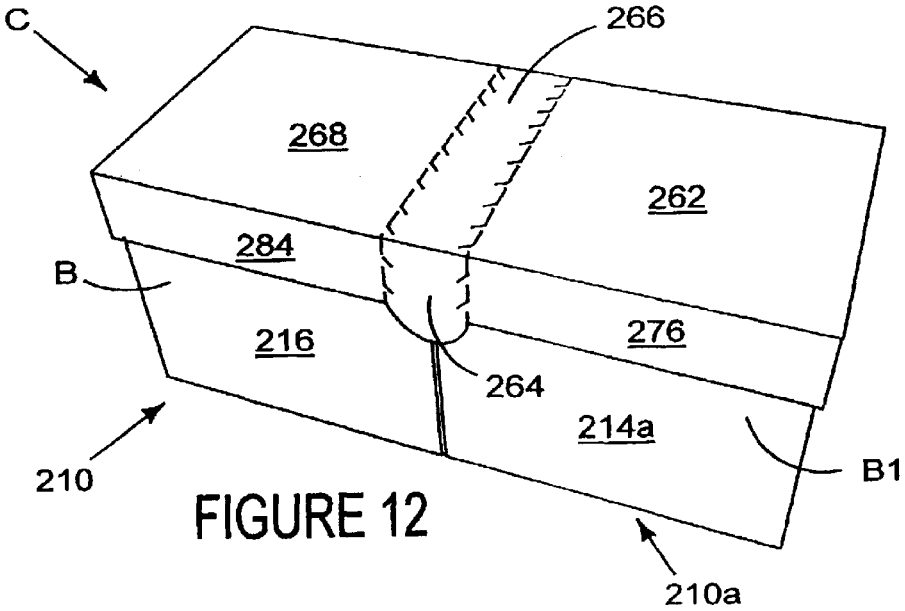
FIG. 12 is a perspective view of the divisible carton formed from the blanks illustrated in FIGS. 10A, 10B and 11.

Turning to the construction of the divisible carton illustrated in FIGS. 10 and 12, it is envisaged that the carton of the present invention can be formed by a series of sequential folding and gluing operations to be performed in a straight line machine, so that the carton is not required to be rotated or inverted to complete its construction. The folding and construction process is not limited to that described below and can be altered according to particular manufacturing requirements.

Figure 11:
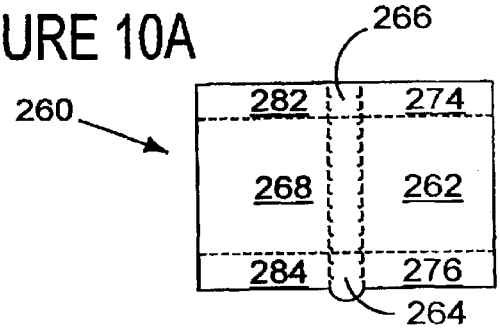
FIG. 11 illustrates the outer cover blank shown in FIG. 9.

Referring to FIGS. 10 and 11, the modular boxes C are constructed first from a pair of blanks 210 and 210*a*. The construction is identical and therefore only the construction of the modular box from blank 210 shall now be described.

The access structure 238 is formed by inwardly folding flaps 240 and 242 along fold lines 246 and 244 respectively. Closure panel 224 is then folded towards base panel 212 along fold lines 228. Thereafter side panels 214 and 216 are inwardly folded along fold lines 218 and 220 to juxtapose wing flaps 240 and 242 respectively.

Securing flaps 230 and 234 are folded along fold lines 232 and 236 to receive end wall panel 222 which is folded inwardly along fold lines 226. Securing flaps 230 and 234 are secured to end panel 222 by glue or other suitable means known in the art.

Thus a modular box B is in a set up condition and is brought into contact with a second modular box B1 formed from a blank 10*a* whereby the cover panels 224 and 224*a* are placed in face contacting arrangement. By orienting the boxes in this way, the end closure panels cannot be inadvertently opened.

Figure 13:
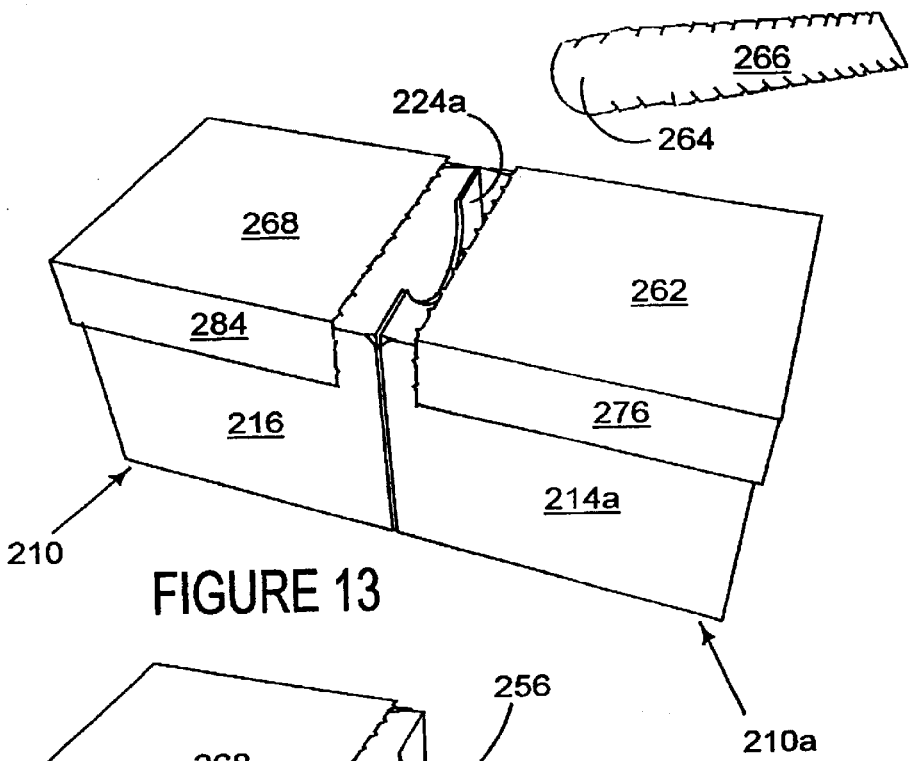
FIG. 13 is a perspective view of the divisible carton showing the modular boxes separated.
Figure 14:
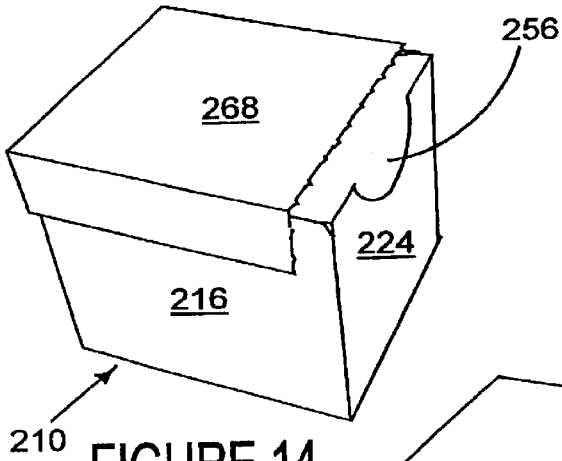
FIGS. 14 and 15 illustrate the opening of the access structure of one of the modular boxes shown in FIG. 13.
Figure 15:
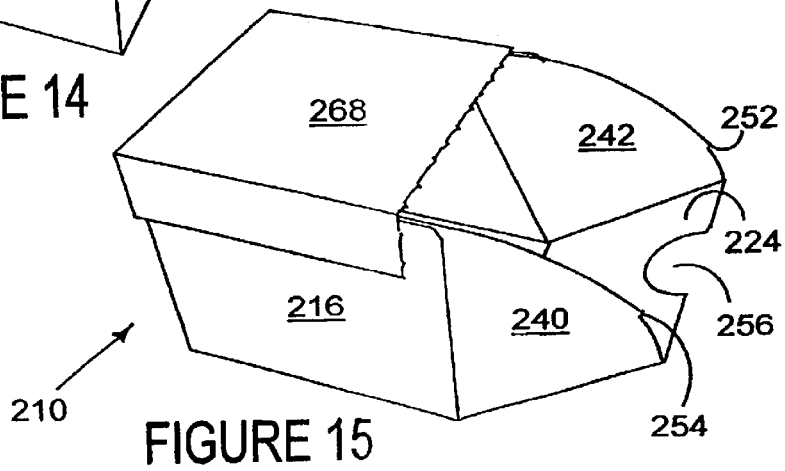

The articles are loaded into the carton by relative vertical movement between the carton and articles during continuous forward feed, as is well known and the outer cover 260 is then applied to complete construction of the carton C, as illustrated in FIG. 12. To secure the outer cover to the modular boxes B and B1, securing panels 274 and 282 and 284 and 276 are folded along fold lines 278, 286, 280 and 288 respectively to be secured to side walls 214*a*, 216*a*; 216 and 214 respectively. Thus the carton is in a set up and loaded condition and ready to be supplied to an end user. In order to gain access to the interior of the divisible carton, it is necessary to separate the modular boxes B and B1. This is achieved by the end user removing the frangible panel 266 from the carton by tearing along frangible lines 270 and 272, as shown in FIG. 13.

To assist the user, a pull tab 264 is provided on the frangible connection panel 266. Each modular box M1 can then be separated. In order to gain access to the interior of the carton, the access structure 238 is used. More particularly, the access structure 238 provides temporary access to the interior of the carton by creating an opening in one of the end walls. The user pulls on the closure panel 224 to cause it to pivot about fold line 228, shown in FIG. 15. Engaging elements 252 and 254 provide an interference type fit against cover panel 268 to prevent closure panel 224 from inadvertently opening beyond a predetermined angle.

To reclose the access structure 238, the closure 224 is pushed inwardly and engaging elements 252 and 254 pushed into abutment with cover panel 268.

Turning to the second embodiment of divisible carton illustrated in FIGS. 16 to 24, there is shown a plurality of open top modular boxes arranged in a substantially vertical arrangement one above the other and connected together by means of an outer cover. The cartons are formed from blanks 310 and 360 formed from paperboard or other suitable foldable sheet material.

Turning to the construction of a modular box from the blank 310, there comprises in series a first side wall panel 314, a base 312 and a second side wall panel 316 hingedly connected together along fold lined 318 and 320. There further comprises opposed end wall panels 322 and 324 hingedly connected to opposing lateral edges of base panel 312 along fold lines 326 and 328 respectively.

In order to secure the side and end wall panels together, there is provided a plurality of securing flaps 330, 331, 334 and 335 that are hingedly connected to end wall panels 324 and 322 respectively along fold lines 322, 336, 333 and 337.

Figure 16:
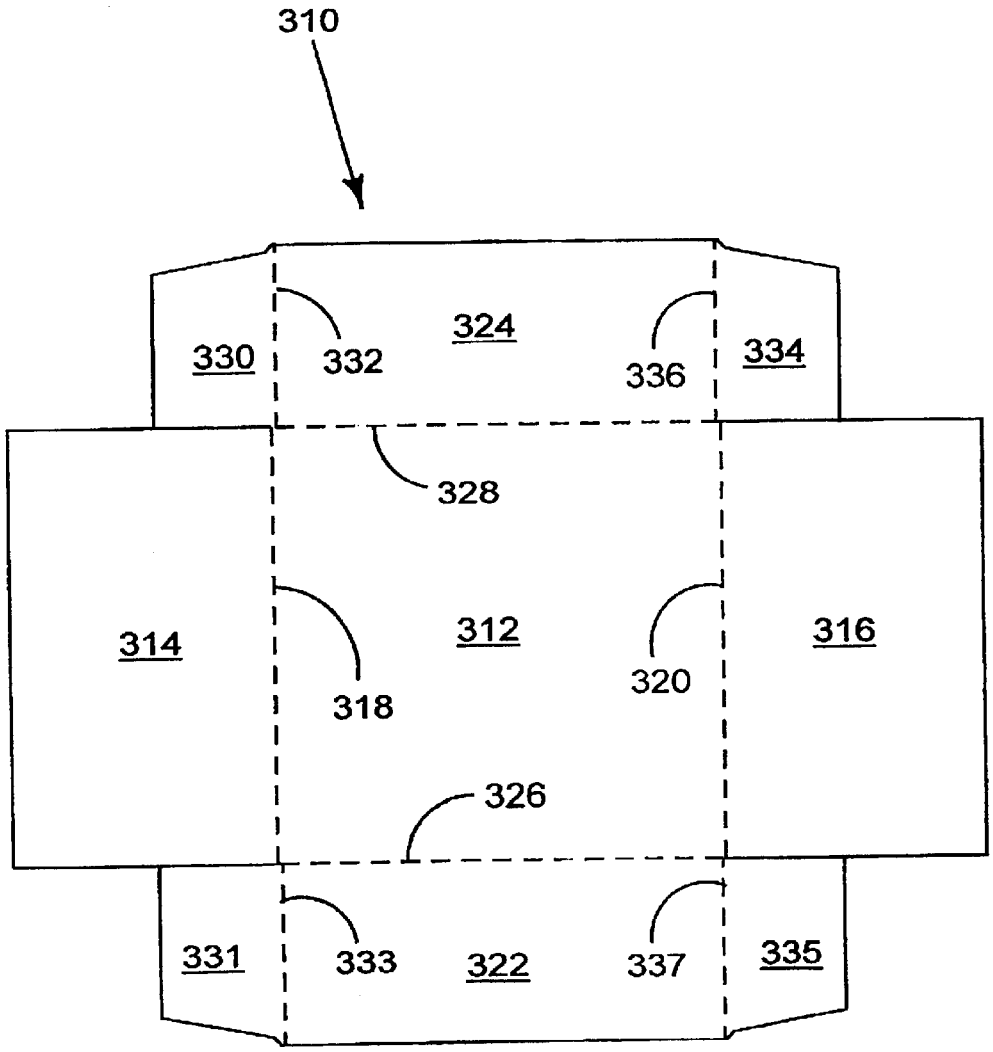
FIG. 16 is a plan view of a blank for forming an open top modular box according to a third embodiment of the invention.
Figure 17:
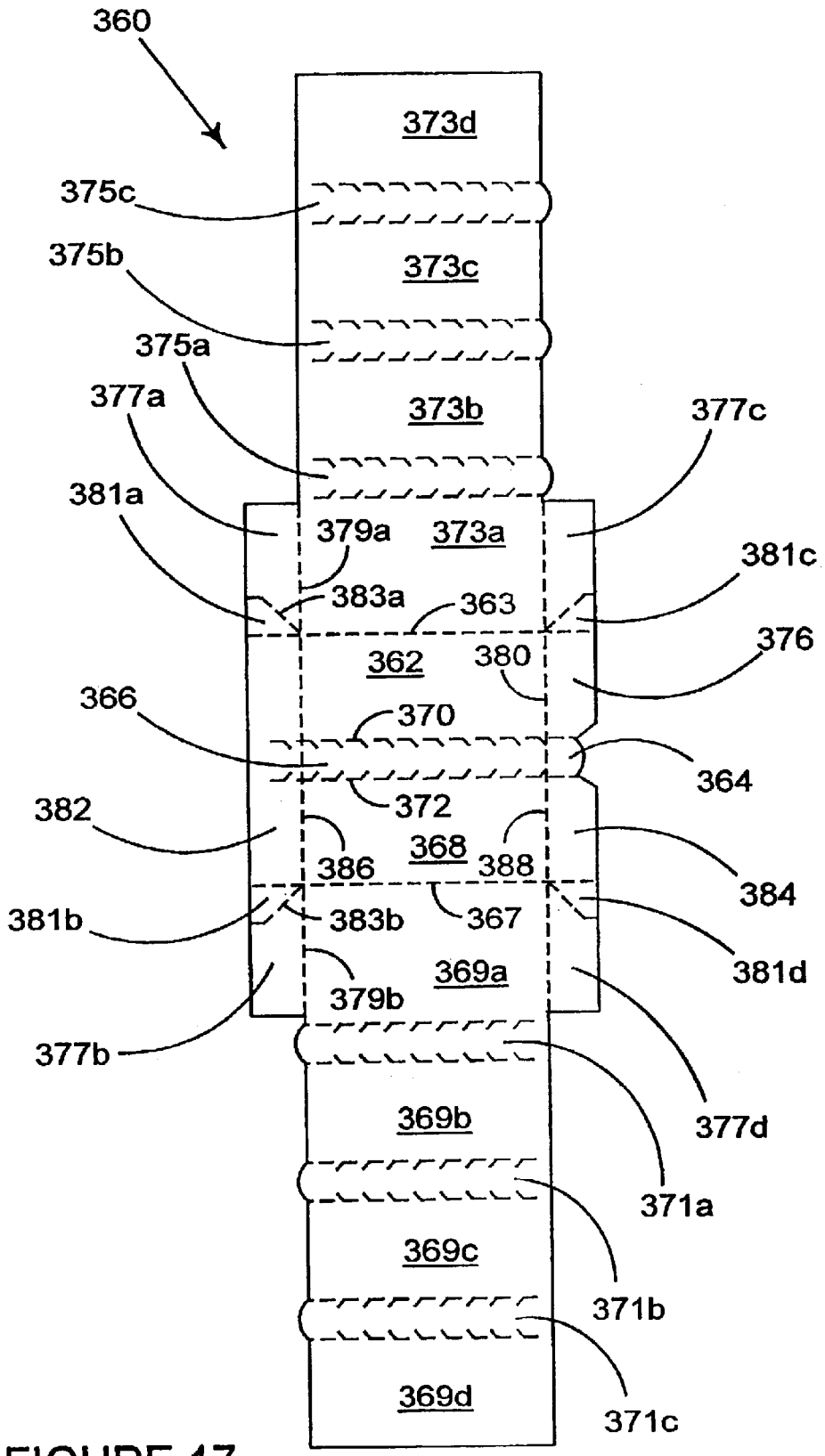
FIG. 17 is a plan view of a blank for forming an outer cover for use with the blank illustrated in FIG. 16.
Figure 18:
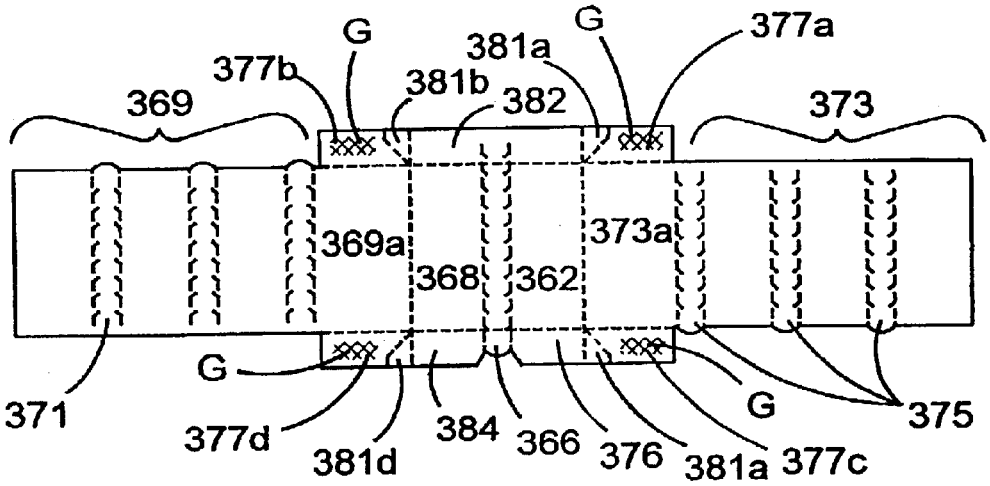
FIGS. 18, 19, 20 and 21 illustrate the construction of the outer cover from the blank illustrated in FIG. 17.
Figure 19:
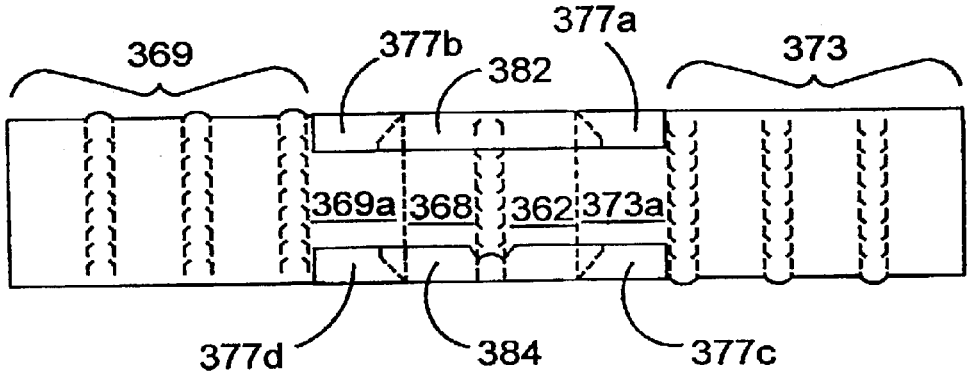

In this embodiment, there comprises two or more modular boxes that are identical or substantially similar to the type hereinbefore described and illustrated in FIG. 16 and therefore shall not be described in any greater detail.

The outer cover is constructed from blank 360.

The blank 360 comprises a first top panel 362 and a second top panel 368 which are connected together by a frangible connecting portion 366. Portion 366 is secured to first top panel 362 along frangible line 370 and to second top cover panel 368 by frangible line 372. The frangible connecting portion 366 may be provided with a pull tab 364 to assist in removing the frangible portion from the divisible cartons.

Outer end wall panels are provided along each side of the top cover panels therefore, along one side of top cover panel 368 there is provided end panel 369 which corresponds in number to the number of modular boxes to be used. In the embodiment illustrated in FIG. 17, there comprises four outer end wall panels 369*a*, 369*b*, 369*c* and 369*d*. Each outer end wall panel is separated by a frangible connecting part 371*a*, 371*b* and 371*c*.

In one class of embodiments there comprises a protruding element which functions as a pull tab to assist in removing the frangible parts 371, described in more detail. Along the opposing side edge of top cover 362 there comprises similar outer end wall panels 373*a* to 373*d* that are separated by frangible connecting portions 375*a*, 375*b* and 375*c*.

In one class of embodiments, there further comprises a retention structure for retaining the modular boxes to avoid inadvertent removal. It will be seen from FIG. 17 that the retention structure may be formed on the opposing longitudinal edges of top cover panels and, optionally, the upper most outer end wall panels 369*a* and 373*a*. A first retention structure is provided by outer side flaps 378 and 382 that are linked by pull tab 366.

Gusset arrangements are provided to connect the side retention panels to the outer end wall panels 369*a* and 373*a*. In this embodiment, side retention panel 382 is hingedly connected to top cover panel 368 along fold line 386 and gusset structure is provided by gusset panels 377*b* and 381*b* hingedly connected to an edge panel 382 along fold line 367 and to end retention wall panel 369*a* along an extension of fold line 386. A fold line 383*b* hingedly interconnects panels 381*b* and 377*b* at an acute angle with respect to fold line 379*b*.

Similarly, side retention panel 376 is hingedly connected to top cover panel 362 along fold line 380 and gusset structure is provided by a pair of gusset panels 377*a* and 381*a* hingedly connected together along the fold line 353*a* which in this embodiment is in an angular relationship with respective fold line 363. Panel 381*a* is hingedly connected to side wall panel 378 along one extension of fold line 363 and gusset panel 377*a* is hingedly connected to end cover panel 373*a* by an extension of fold line 380. On the opposing longitudinal of cover panels 362 and 368 there is provided opposing side cover panel 384 which is hingedly connected thereto along fold line 388. In this embodiment, gusset structures are provided along each lateral edge and is substantially identical to gusset panels described in the preceding paragraph and are not therefore described in any greater detail.

In order to construct the outer cover and modular boxes, it is envisaged that the divisible carton of the present invention can be formed by a series of sequential folding and gluing operations performed in a straight line machine so that the divisible carton is not required to be rotated or inverted to complete its construction.

The modular boxes are constructed by folding side panels 314 and 316 and end panel 322 and 324 out of alignment with base panel 312 along fold lines 318, 320; 326 and 328 respectively and securing the aforesaid panels to the securing flaps 330, 331, 334 and 335.

The construction of the outer cover will be described by reference to FIGS. 18, 19, 20 and 21. The first step is for the retention structures to be formed whereby gusset panels 377*b*, 377*d*, 377*a* and 377*c* are secured to the adjacent outer end panels 369*a* and 373*a* using glue or other suitable means known in the art whilst side cover panels 382, 376 and 384 along fold lines 379 and 386; 388 and 380. Thus, the outer cover panel is in a flat collapsed position in FIG. 19.

Figure 20:
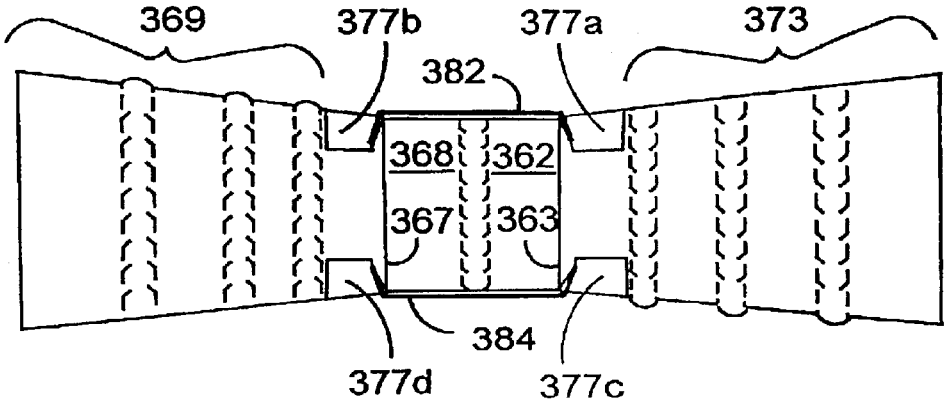
Figure 21:
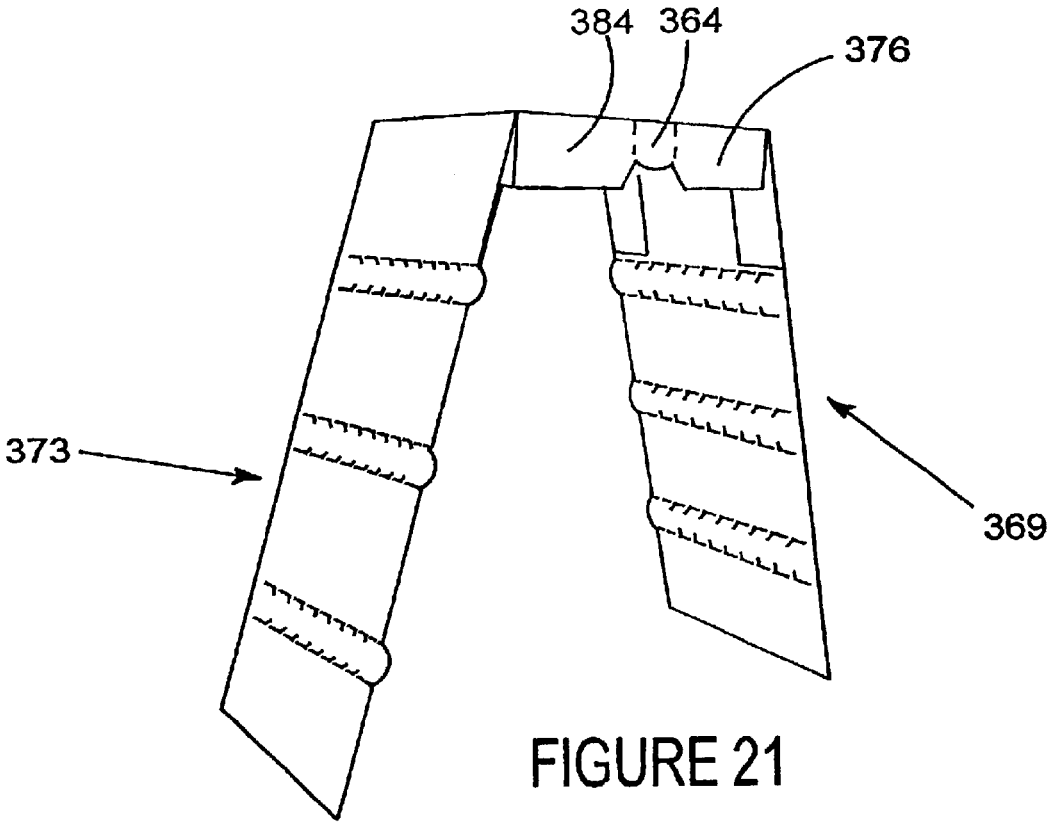
Figure 22:
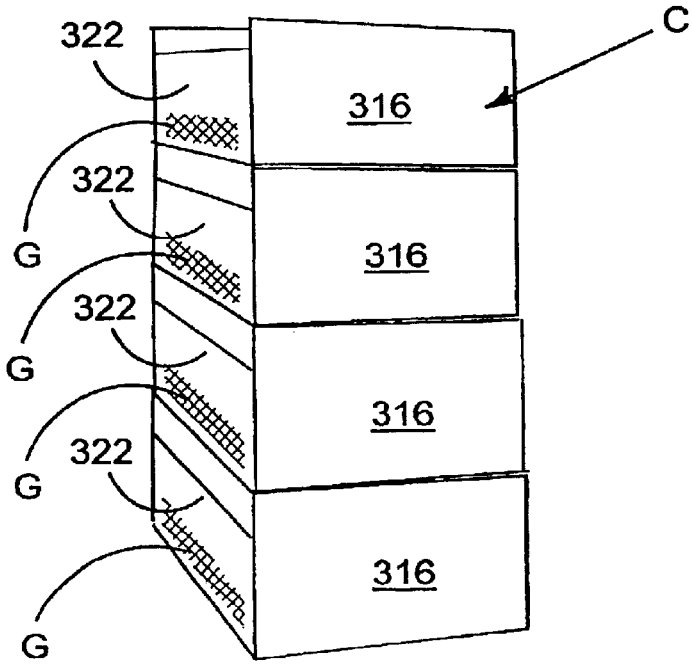
FIG. 22 is a perspective view of a plurality of open top modular boxes stacked in a vertical arrangement ready to receive the outer cover shown in FIG. 21.
Figure 27A:
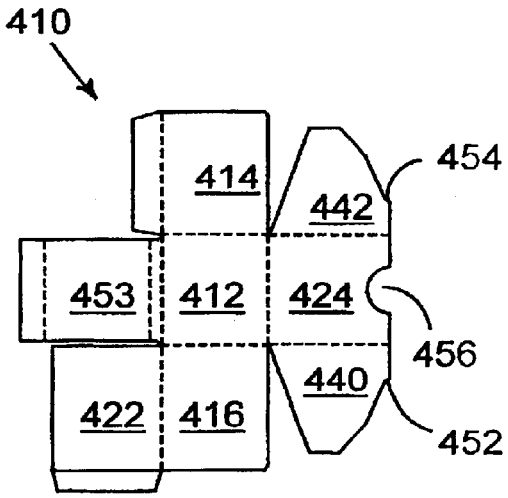
FIGS. 27A, 27B, 28 and 29 illustrate the construction of the divisible carton from the blanks of FIGS. 25 and 26.
Figure 27B:
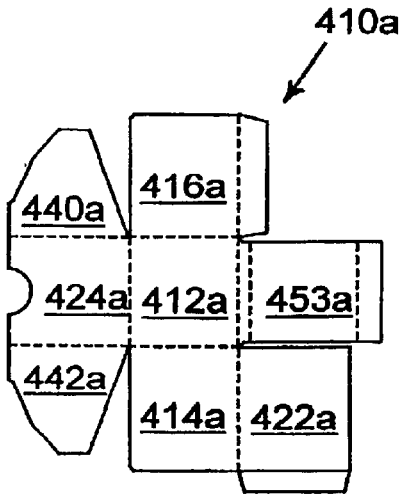
Figure 28:
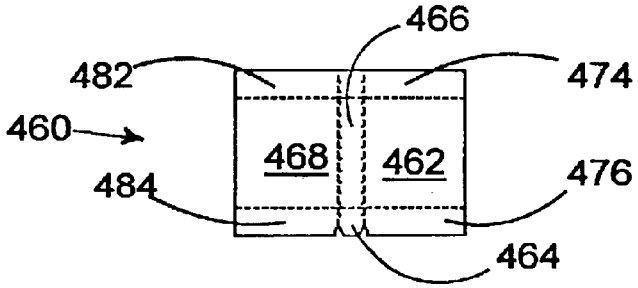
Figure 29:
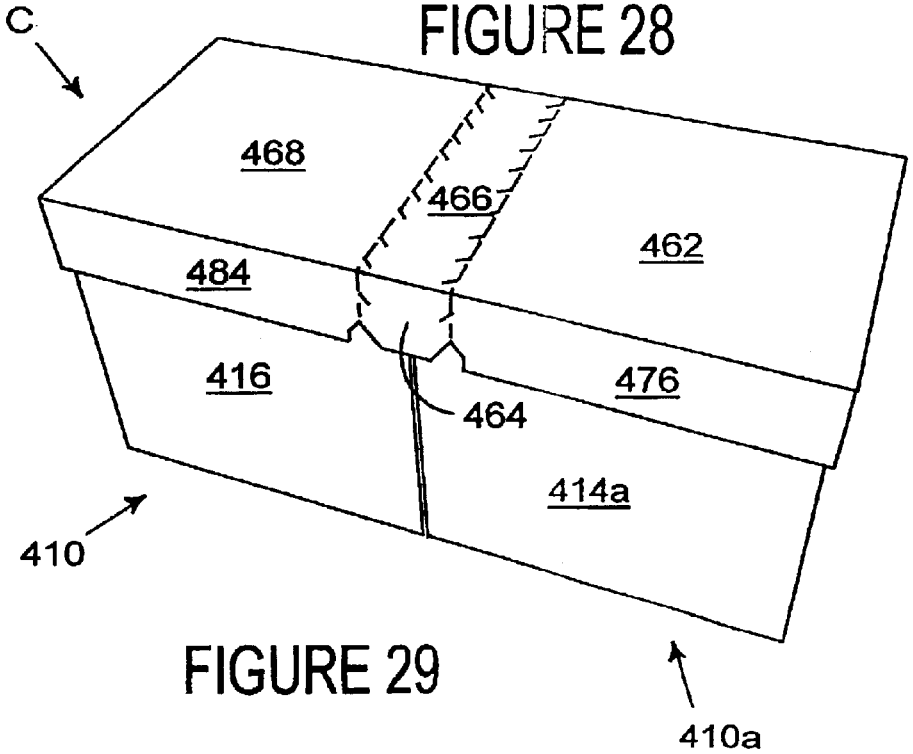

The side retention panels 372, 382 and 376, 384 are folded out of face contacting relationship with top cover panel 362, 368 by folding the end cover panels 369 and 373 inwardly along fold lines 367 and 363 respectively. This action causes the side retention panels to be folded along fold lines 383*a*, 383*b*, 383*c* and 383*d* along fold lines 367 and 363 so as to be automatically deployed in a substantially perpendicular arrangement with top cover panels 362 and 368 as shown in FIGS. 20 and 27.

The outer cover is then applied to the open top modular boxes that are stacked in a vertical arrangement, one above the other, and the end panels 322 and 324 are secured to outer end cover panels 373 and 369 respectively glue G or other suitable means known in the art.

Figure 23:
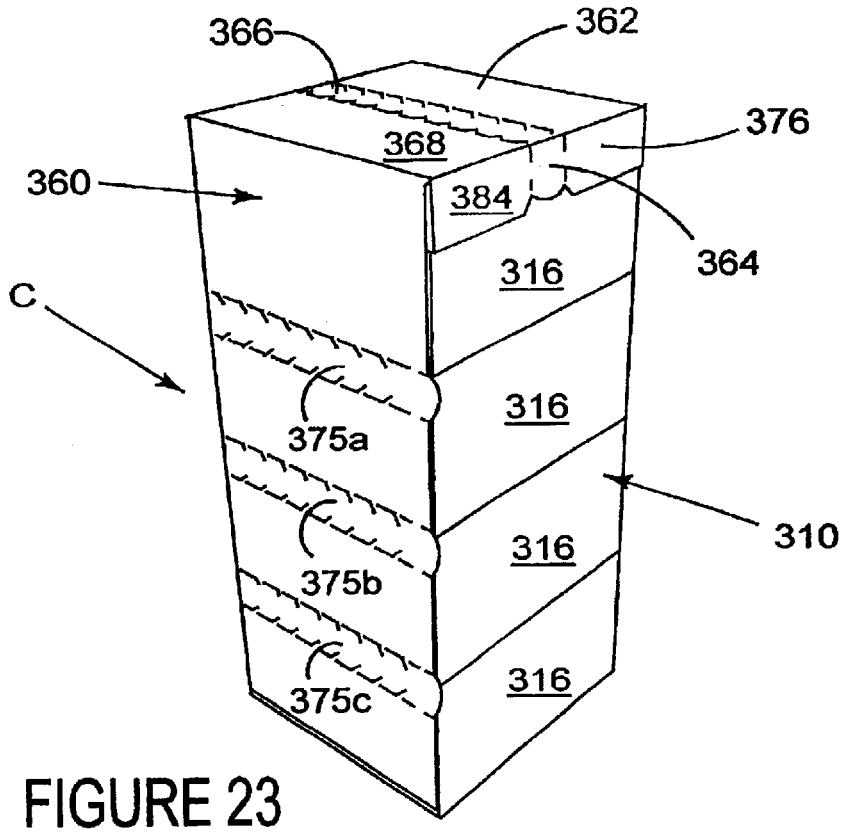
FIG. 23 is a perspective view of the divisible carton in a set up and loaded condition.
Figure 24:
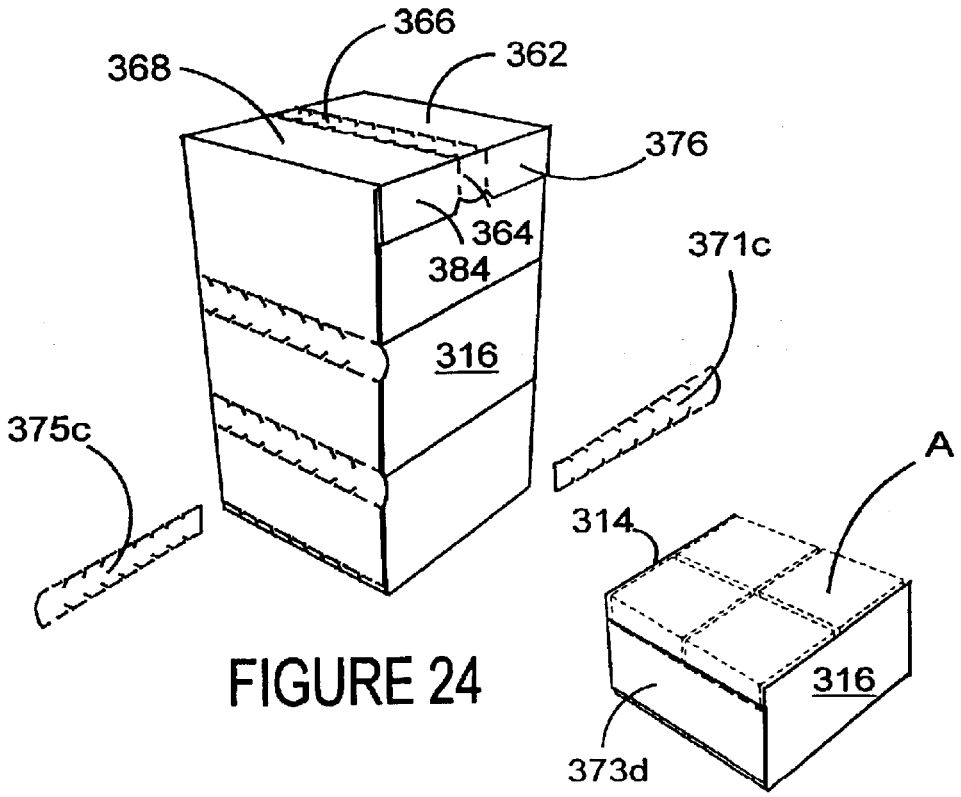
FIG. 24 is a perspective view of the separation of an open top modular box from the divisible carton of FIG. 23.
Figure 25:
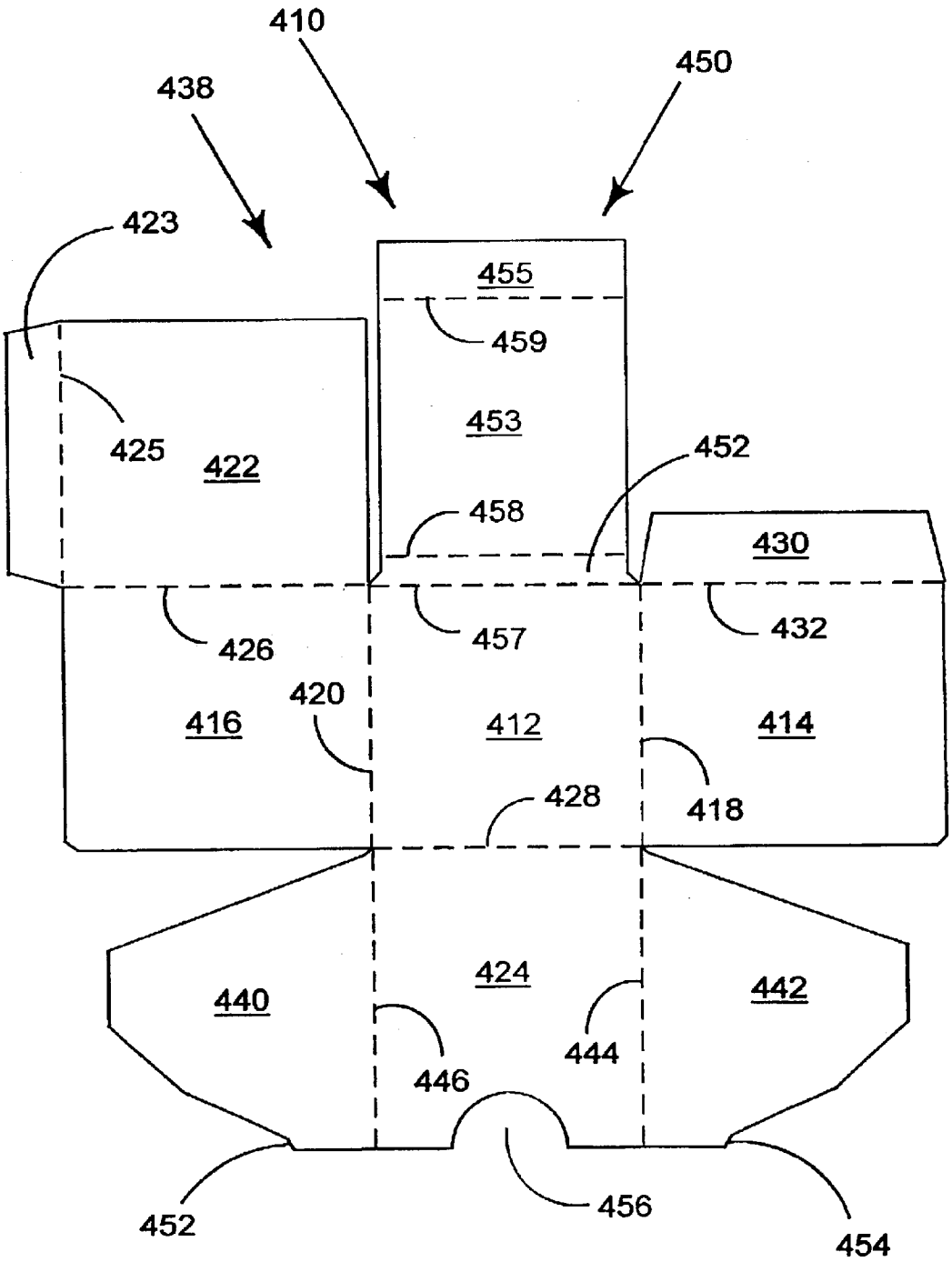
FIG. 25 is a plan view of a blank for forming a modular box according to a fourth embodiment of the invention.
Figure 26:
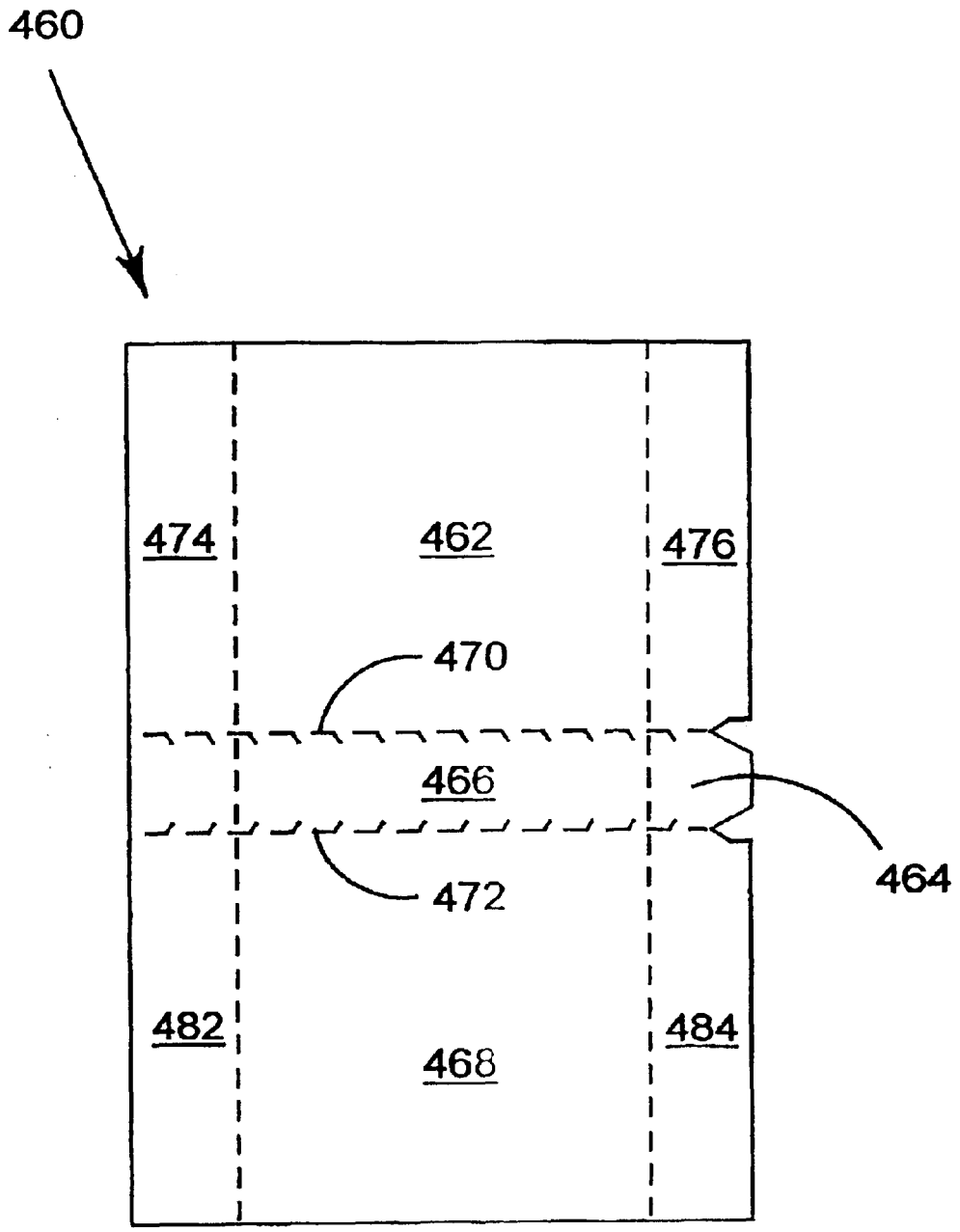
FIG. 26 is a plan view of a blank for forming an outer cover to be used with the blank illustrated in FIG. 25.

Thus the carton C is in a set up and loaded condition as illustrated in FIG. 23.

In order to gain access to the interior of the divisible carton, it is necessary to separate the modular boxes. This is achieved by removing the frangible panels 371 and 375 shown in FIG. 24. Thus the end user has access to articles A. One advantage of this arrangement is that the modular boxes are arranged so that the side panels 314, 316 are to be at a higher vertical elevation than the end wall panels so that the modular boxes can nest together.

Turning to the third embodiment illustrated in FIGS. 25 to 31 there comprises a pair of blanks 410 and 460 for forming the modular box and outer cover respectively. The blanks 410 and 460 are substantially identical to the first embodiment and therefore like parts have been designated by the same reference numeral and prefixed with the number "4". Therefore any of the differences shall be described in any greater detail.

In this embodiment there comprises a platform structure, described in more detail above.

The platform comprises a base end panel 452, a platform panel 453 and a securing flap 455 hingedly connected together along fold lines 458 and 459 respectively.

The construction of the divisible carton from the blanks 410 and 460 are substantially identical to that described in the first embodiment, the only difference being that the platform 450 is first folded along fold lines 457 and securing flaps 455 is secured to cover panel 424 by glue or other suitable means known in the art.

Figure 30:
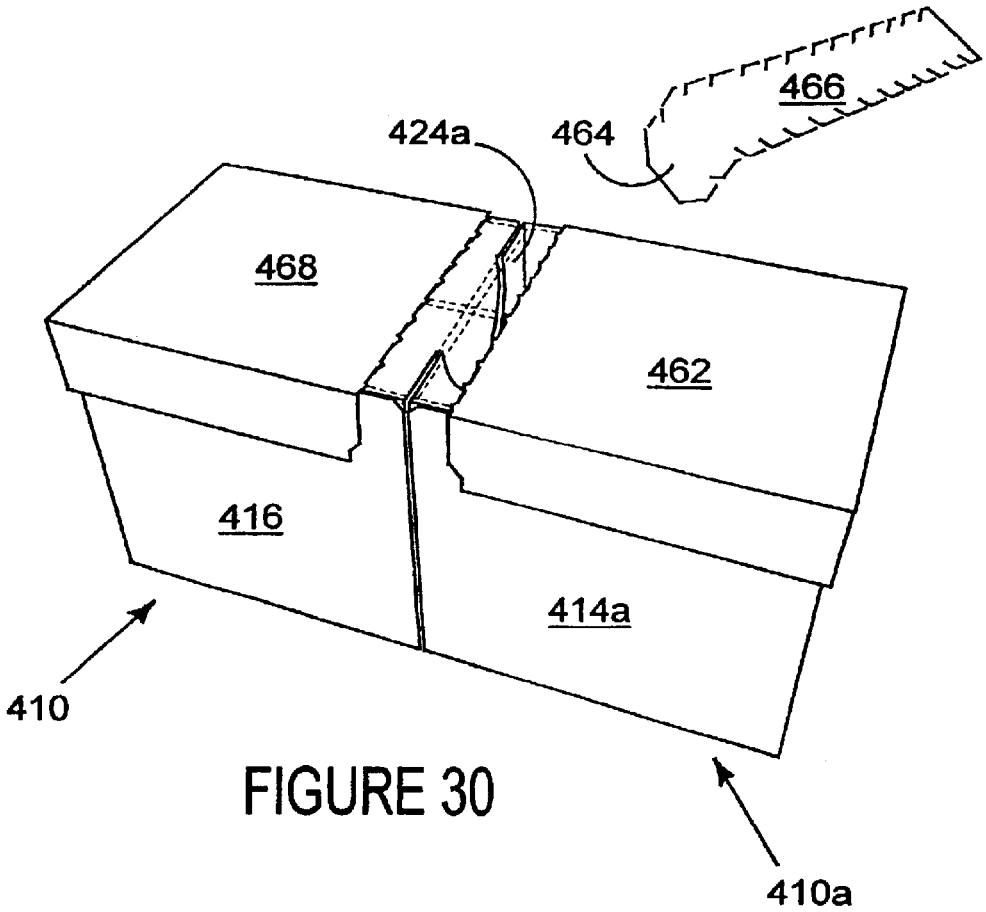
FIGS. 30 and 31 illustrate the separation of the divisible carton of FIG. 29 and the opening of the access structure also shown in FIG. 7.
Figure 31:
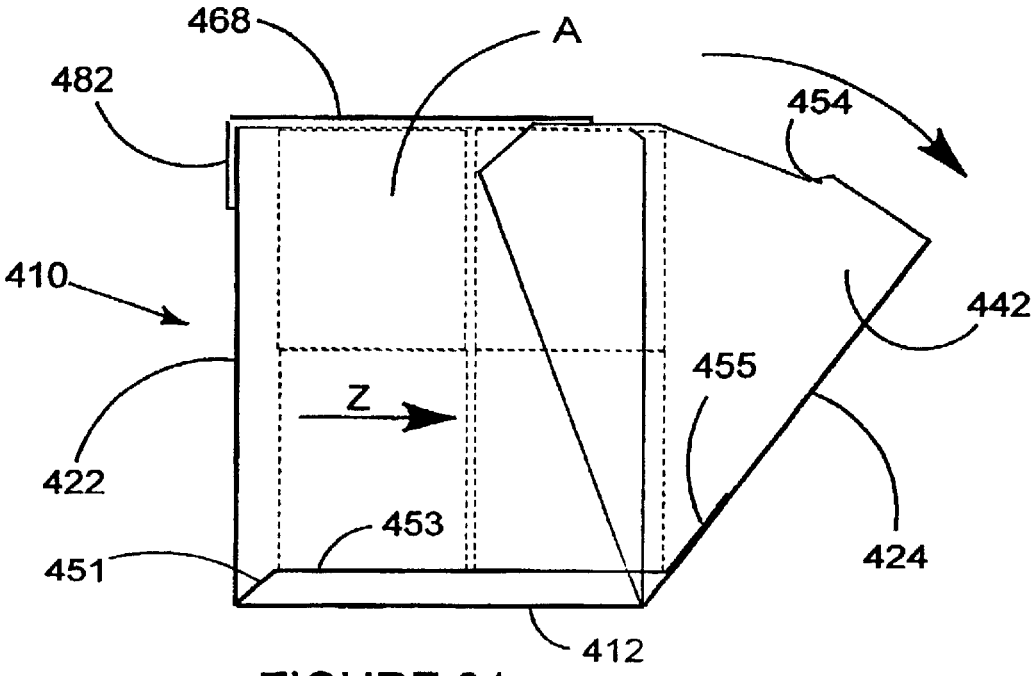

Similarly, when the end user wants to gain access to the interior of the carton, the frangible connecting panel 466 is removed from the outer cover as shown in FIG. 30 and the closure panel 424 is opened in a similar manner to that described above. The pivoting action of closure panel 424 causes the platform 453 to move forward thereby to assist in moving the articles in direction Z so as to be removed more easily by the end user.

It will also be recognised that as used herein, directional references such as "top", "base", "end", "side", "lateral", "longitudinal", "upper" and "lower" do not limit the respective panels to such orientation, but merely serve to distinguish these panels one from another. Any reference to hinged connection should not be construed as necessarily referring to a single fold line only: indeed it is envisaged that hinged connection can be formed from one or more of one of the following, a score line, a frangible line or a fold line, without departing from the scope of invention.

The present invention and its preferred embodiment relates to an article carrier that is shaped to provide satisfactory strength to hold articles securely, but with a degree of flexibility so that during transit the articles are retained within the carrier. The shape of the blank minimises the amount of paperboard required and the carrier can be applied to one or more articles by hand or automatic machinery. It is anticipated that the invention can be applied to a variety of carriers and is not limited to those of the fully enclosed type hereinabove described. Further or alternatively, the carton may be adapted to carry a greater number of articles without departing from the scope of the invention.

What is claimed is:

1. A carton for accommodating one or more articles, said carton comprising an access structure for removal of articles from within the carton, said access structure comprising a closure panel hinged to a first carton wall for forward and backward pivotal movement between an opened position where said closure panel opens an access aperture of the carton and a closed position where said closure panel closes said access aperture, and a movable platform mounted within the carton and hinged to said closure panel for movement along with said closure panel so that said platform is moved toward said access aperture in response to forward pivotal movement of said closure panel, said platform comprising a platform panel upon which articles are placed and a spacer panel disposed between said platform panel and said first carton wall to retain said platform panel spaced from said first carton wall, said spacer panel being hingedly connected to both said platform panel and said first carton wall.

2. The carton as claimed in claim 1 wherein said platform panel is connected to said closure panel to move forwardly and downwardly to present articles thereon for removal as said closure panel is moved to said opened position.

3. The carton as claimed in claim 2 wherein said platform further comprises a securing flap secured to said closure panel and hingedly connected to said platform panel along a fold line spaced from said first carton wall.

4. The carton as claimed in claim 1, said platform further comprises a pusher element linked to said closure panel to push an article placed directly on said platform panel forward in response to forward movement of said closure panel.

5. The carton as claimed in claim 4 wherein said pusher element extends upward from said spacer panel.

6. The carton as claimed in claim 4 wherein said pusher element is linked to said closure panel by said platform panel.

7. A carton for accommodating one or more articles, said carton comprising an access structure for removal of articles from within the carton, said access structure comprising a closure panel hinged to a first carton wall for forward and backward pivotal movement between an opened position where said closure panel opens an access aperture of the carton and a closed position where said closure panel closes said access aperture, and a movable platform mounted within the carton and hinged to said closure panel for movement alone with said closure panel so that said platform is moved toward said access aperture in response to forward pivotal movement of said closure panel, the carton further comprising a pusher element linked to said closure panel to push an article held within the carton forward in response to forward movement of said closure panel, wherein said pusher element is hinged at a lower edge thereof to said first carton wall.

8. A carton for accommodating one or more articles, said carton comprising an access structure for removal of articles from within the carton, said access structure comprising a closure panel hinged to a first carton wall for forward and backward pivotal movement between an opened position where said closure panel opens an access aperture of the carton and a closed position where said closure panel closes said access aperture, and a movable platform mounted within the carton and hinged to said closure panel for movement alone with said closure panel so that said platform is moved toward said access aperture in response to forward pivotal movement of said closure panel, the carton further comprising a pusher element linked to said closure panel to push an article held within the carton forward in response to forward movement of said closure panel, wherein said pusher element is linked to said closure panel by said platform spaced from said first carton wall.

9. The carton as claimed in claim 8 wherein articles held within the carton are placed upon said platform.

10. A carton for accommodating one or more articles, said carton comprising an access structure for removal of articles from within the carton, said access structure comprising a closure panel hinged to a first carton wall for forward and backward pivotal movement between an opened position where said closure panel opens an access aperture of the carton and a closed position where said closure panel closes said access aperture, and a movable platform mounted within the carton and hinged to said closure panel for movement along with said closure panel so that said platform is moved toward said access aperture in response to forward pivotal movement of said closure panel, said carton further comprising at least one wing flap hinged to said closure panel and extending into the carton for movement along with said closure panel, wherein said one wing flap has an anchoring element for engaging with a second carton wall to retain said closure panel in said closed position.

11. The carton as claimed in claim 10 wherein said one wing flap further comprises a stopper element for limiting outward movement of said closure panel, said stopper element being spaced from said anchoring element.

12. The carton as claimed in claim 10 wherein said anchoring element comprises a protrusion positioned on an upper edge of said one wing flap.

13. The carton as claimed in claim 11 wherein said stopper element comprises a protrusion positioned on an upper edge of said one wing flap.

14. A blank for forming a carton for accommodating one or more articles, said blank comprising a plurality of wall panels hingedly connected together for forming a top, a base and opposed side and end walls and a closure panel hinged at a lower edge of said closure panel to said base for forward and backward pivotal movement in a set up condition, wherein said blank further comprises a pusher element hinged at a lower edge of said pusher element to said base, a platform panel hingedly connected to an intermediate portion of said pusher element and a securing flap connected to said platform panel for securing said platform panel to said closure panel.

* * * * *